US010987556B2

(12) United States Patent
Gray et al.

(10) Patent No.: US 10,987,556 B2
(45) **Date of Patent: *Apr. 27, 2021**

(54) BAT WITH BARREL PIVOT JOINT

(71) Applicant: Wilson Sporting Goods Co., Chicago, IL (US)

(72) Inventors: Adam G. Gray, Roseville, CA (US); James M. Earley, Roseville, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/678,971

(22) Filed: Nov. 8, 2019

(65) Prior Publication Data

US 2020/0070021 A1 Mar. 5, 2020

Related U.S. Application Data

(63) Continuation-in-part of application No. 15/166,427, filed on May 27, 2016, now Pat. No. 10,507,367, and a continuation-in-part of application No. 15/381,260, filed on Dec. 16, 2016.

(51) Int. Cl.

| | |
|---|---|
| ***A63B 59/56*** | (2015.01) |
| ***A63B 60/54*** | (2015.01) |
| ***A63B 102/18*** | (2015.01) |

(52) U.S. Cl.

CPC ..... *A63B 59/56* (2015.10); *A63B 60/54* (2015.10); *A63B 2102/18* (2015.10)

(58) Field of Classification Search

CPC ..... A63B 59/56; A63B 60/54; A63B 2102/18; A63B 59/50; A63B 60/52; A63B 60/04; A63B 60/42; A63B 60/50; A63B 60/16; A63B 60/00801

See application file for complete search history.

(56) References Cited

U.S. PATENT DOCUMENTS

| | | | |
|---|---|---|---|
| 1,499,128 | A | 6/1924 | Shroyer, Jr. |
| 3,116,926 | A | 1/1964 | Owen |
| 3,392,976 | A | 7/1968 | Hayes |
| 4,128,242 | A | 12/1978 | Elkins, Jr. |
| 4,274,631 | A | 6/1981 | Hayazaki |
| 4,898,386 | A | 2/1990 | Anderson |
| 4,951,948 | A | 8/1990 | Peng |
| 5,080,363 | A | 1/1992 | Soong |
| 5,219,164 | A | 6/1993 | Peng |
| 5,277,421 | A | 1/1994 | Rewolinski |
| 5,393,055 | A | 2/1995 | MacKay, Jr. |
| 5,511,777 | A | 4/1996 | McNeely |
| 5,590,875 | A | 1/1997 | Young |
| 6,077,178 | A | 6/2000 | Brand |
| 6,530,852 | B2 | 3/2003 | Rios |

(Continued)

*Primary Examiner* — Jeffrey S Vanderveen

(74) *Attorney, Agent, or Firm* — Terence P. O'Brien; Todd A. Rathe

(57) ABSTRACT

A ball bat configured for impacting a ball. The ball bat extends along a longitudinal axis and includes a unitary bat frame and a pivot joint. The unitary bat frame includes a handle portion and a barrel portion having a distal region. The pivot joint is coupled to the distal region of the barrel portion. The pivot joint movably supports the barrel portion relative to the longitudinal axis such that the distal region of the barrel portion may pivot towards and away from the longitudinal axis about the pivot joint.

15 Claims, 17 Drawing Sheets

(56) References Cited

U.S. PATENT DOCUMENTS

| | | | | |
|---|---|---|---|---|
| 6,767,299 | B1 | 7/2004 | Chang | |
| 6,783,471 | B2 | 8/2004 | Bolduc et al. | |
| 6,875,137 | B2 | 4/2005 | Forsythe et al. | |
| 6,905,429 | B2 | 6/2005 | Forsythe et al. | |
| 7,014,580 | B2 | 3/2006 | Forsythe et al. | |
| 7,044,871 | B2 | 5/2006 | Sutherland et al. | |
| 7,052,419 | B2 | 5/2006 | Chang | |
| 7,053,419 | B1 | 5/2006 | Camras et al. | |
| 7,140,988 | B1 | 11/2006 | Hinman | |
| 7,166,046 | B1 | 1/2007 | Liu | |
| 7,201,679 | B2 | 4/2007 | Nguyen | |
| 7,264,098 | B2 | 9/2007 | McPherson | |
| 7,267,619 | B1 | 9/2007 | Pettis | |
| 7,311,620 | B1 | 12/2007 | Heald et al. | |
| 7,399,242 | B1 | 7/2008 | Smith | |
| 7,572,197 | B2 | 8/2009 | Chauvin et al. | |
| 7,980,970 | B2 | 7/2011 | Watari et al. | |
| 8,226,505 | B2 | 7/2012 | Burger | |
| 8,632,428 | B2 | 1/2014 | Burger | |
| 8,888,614 | B2 | 11/2014 | Nutter | |
| 9,669,277 | B1 | 6/2017 | Haas et al. | |
| 9,814,956 | B2 | 11/2017 | Burger et al. | |
| 2002/0094892 | A1 | 7/2002 | Chauvin et al. | |
| 2003/0013563 | A1* | 1/2003 | Ryan | A63B 60/20 473/457 |
| 2005/0143203 | A1 | 6/2005 | Souders et al. | |
| 2007/0155546 | A1* | 7/2007 | Chauvin | A63B 59/00 473/520 |
| 2011/0111892 | A1 | 5/2011 | Thouin et al. | |
| 2011/0111894 | A1 | 5/2011 | Thouin | |
| 2011/0172038 | A1 | 7/2011 | Watari et al. | |
| 2014/0080641 | A1 | 3/2014 | Epling et al. | |
| 2014/0080642 | A1 | 3/2014 | Epling et al. | |
| 2014/0206483 | A1 | 7/2014 | Goodwin et al. | |
| 2014/0221137 | A1 | 8/2014 | Krysiak et al. | |
| 2014/0235378 | A1 | 8/2014 | Albin | |
| 2014/0274491 | A1 | 9/2014 | Long et al. | |
| 2014/0274493 | A1 | 9/2014 | Heussner | |
| 2015/0182771 | A1 | 7/2015 | Sililik | |
| 2016/0096092 | A1* | 4/2016 | Williams | A63B 59/50 473/564 |

* cited by examiner

BAT WITH BARREL PIVOT JOINT

RELATED U.S. APPLICATION DATA

The present invention is a continuation-in-part of U.S. patent application Ser. No. 15/166,427, entitled "Bat With Barrel Pivot Joint," filed on May 27, 2016, and claims the benefit of 35 U.S.C. § 120. The present invention is also a continuation-in-part of U.S. patent application Ser. No. 15/381,260, entitled "Bat With Barrel Inner Tube Weight," filed on Dec. 16, 2016, and claims the benefit of 35 U.S.C. § 120.

FIELD OF THE INVENTION

The present invention relates to the use of one or more pivot joints in association with a barrel portion of a ball bat.

BACKGROUND

Baseball and softball are very popular sports in the United States, Japan, Cuba, and elsewhere. Ball bats impart or receive impact forces upon impacting a ball and transmit the shock and vibrations from the impact through the handle of the bat to the hands of the batter. Impacts occurring away from the "sweet spot" of the ball bat generally result greater shock and vibrational energy transferring to the batters hands. Many batters find such shock and/or vibrational energy to be uncomfortable and/or painful. Some players refer to this event as being "stung" by the bat. The fear of pain or discomfort upon hitting a ball away from the "sweet spot" can negatively affects a batter's performance, particularly many younger players.

Baseball and softball organizations periodically publish and update equipment standards and/or requirements including performance limitations for ball bats. It is not uncommon for ball bat manufacturers to adjust the design and/or construction of their ball bats to ensure that such bats satisfy the new or updated standards. As a result, the maximum performance level of high end ball bats used in organized, competitive play are designed not to exceed applicable performance limits. Many ball bat manufacturers seek to provide ball bat designs and/or constructions that provide a near maximum performance levels across a larger area or region of the bat barrel.

Accordingly, a continuing need exists for an improved ball bat that reduces the amount of shock and/or vibrational energy from a ball impact being transmitted to the batter's hands. What is also desired is a high performance ball bat that satisfies applicable maximum performance rules and/or standards and also provides near maximum performance along a greater region of the bat barrel.

SUMMARY OF THE INVENTION

The present invention provides a ball bat extending along a longitudinal axis. The bat includes a handle portion, a barrel portion and an end cap. The barrel portion includes a proximal region and a distal region. The proximal region of the barrel portion is coupled to the handle portion by a first pivot joint. The distal region of the barrel portion is coupled to the end cap by a second pivot joint. The first and second pivot joints movably support the barrel portion relative to the longitudinal axis.

According to one implementation of the invention, a ball bat for impacting a ball includes a barrel portion coupled to, and extending from, a handle portion and an end cap. One of the barrel portion and the end cap includes a socket, and the other of the barrel portion and the end cap includes a rounded head received within the socket to form a first pivot joint. The first pivot joint facilitates pivoting of the barrel portion with respect to the end cap upon impact with the ball.

This invention will become more fully understood from the following detailed description, taken in conjunction with the accompanying drawings described herein below, and wherein like reference numerals refer to like parts.

DETAILED DESCRIPTION OF EXAMPLES

Figure 1:
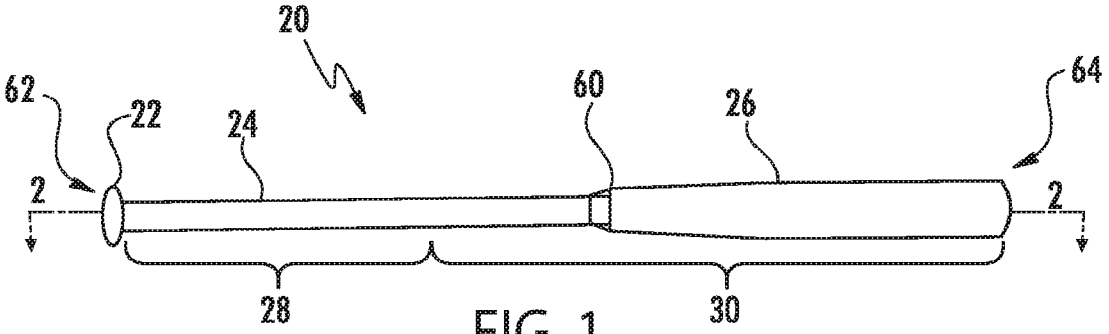
FIG. 1 is a side view of an example baseball or softball bat.
Figure 2:
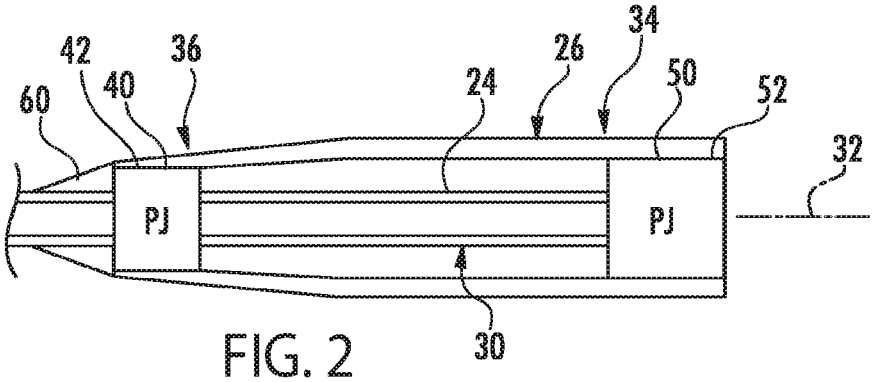
FIG. 2 is a fragmentary sectional view of a portion of the bat of FIG. 1.

FIGS. 1 and 2 illustrate an example baseball or softball bat 20. FIG. 2 is an enlarged fragmentary sectional view of a portion of bat 20. Bat 20 comprises a knob 22, a handle portion 24, a barrel portion 26, a pivot joint 40, a pivot joint 50 and a transitioner 60. As will be described hereafter, bat 20 has barrel portion 26 and a pivot joint 50 that pivotably supports a distal region of the barrel portion 26. The pivot joint 50 enhances deflection of the barrel portion 26 to enlarge the hitting zone or improve the performance of the barrel portion 26 as a whole, or in locations near the pivot joint 50.

Knob 22 extends at proximal end 62 of the handle portion 24 of the bat 20, and has a diameter wider than that of handle portion 24. In one implementation, knob 22 is coupled or directly attached to handle portion 24. In yet another implementation, knob 22 is integrally formed as a single unitary body with handle portion 24.

Handle portion 24 comprises elongate structure extending from knob 22 towards a distal end 64 of bat 20. Handle portion 24 has a proximal region 28 sized to be gripped by a batter's hands. Handle portion 24 has a distal region 30 connected to barrel portion 26. As shown by FIG. 2, in the example illustrated, handle portion 24 extends into barrel portion 26. In the example illustrated, handle portion 24 extends through a majority of the length of the barrel portion 26, centered along and about a centerline 32 or longitudinal axis of barrel portion 26 and of bat 20. In the example illustrated, handle portion 24 extends to a distal region 34 of barrel portion 26 where handle portion 24 is connected to the distal region 34 of barrel portion 26 by pivot joint 50. As will be described hereafter, in other implementations, handle portion 24 may terminate prior to reaching distal region 34 of barrel portion 26.

In the example illustrated, distal region 30 of handle portion 24 has a constant or uniform diameter along its length. In the example illustrated, handle portion 24 has a constant or uniform diameter along its entire length, including the proximal region 28 and distal region 30. The uniform or constant diameter of handle portion 24 facilitates fabrication or manufacturing of handle portion 24. In one implementation, handle portion 24 has an outer diameter of at least 0.5 inch and no greater than 1.25 inches. In yet other implementations, handle portion 24 may have other outer diameters. In other implementations, handle portion 24 may have a varying diameter along its length.

The handle portion 24 is formed of a strong, generally flexible, lightweight material, preferably a fiber composite material. Alternatively, the handle portion 16 can be formed of other materials such as an aluminum alloy, a titanium alloy, steel, other alloys, a thermoplastic material, a thermoset material, wood or combinations thereof. As used herein, the terms "composite material" or "fiber composite material" refer to a plurality of fibers impregnated (or permeated throughout) with a resin. In one preferred embodiment, the fibers can be systematically aligned through the use of one or more creels, and drawn through a die with a resin to produce a pultrusion, as discussed further below. In an alternative preferred embodiment, the fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In other implementations, more than 8 layers can be used. In yet other implementations, the layers may be thinner, wherein the number of layers ranges from 20 to 30 layers, nominally 25 layers. In multiple layer constructions, the fibers can be aligned in different directions (or angles) with respect to the longitudinal axis 32 including 0 degrees, 90 degrees and angular positions between 0 to 90 degrees, and/or in braids or weaves from layer to layer. For composite materials formed in a pultrusion process, the angles can range from 0 to 90 degrees. In some implementations, the layers may be separated at least partially by one or more scrims or veils. When used, the scrim or veil will generally separate two adjacent layers and inhibit resin flow between layers during curing. Scrims or veils can also be used to reduce shear stress between layers of the composite material. The scrim or veils can be formed of glass, nylon, thermoplastic materials, rubber, other elastomeric materials, or combinations thereof. In one particular embodiment, the scrim or veil can be used to enable sliding or independent movement between layers of the composite material. The fibers are formed of a high tensile strength material such as graphite. Alternatively, the fibers can be formed of other materials such as, for example, glass, carbon, boron, basalt, carrot, aramid, Spectra®, poly-para-phenylene-2, 6-benzobisoxazole (PBO), hemp and combinations thereof. In one set of preferred embodiments, the resin is preferably a thermosetting resin such as epoxy or polyester resins.

Barrel portion 26 comprises an elongate hollow tubular member which provides a hitting zone or surface for bat 20. In one implementation, barrel portion 26 is formed from aluminum. In another implementation, barrel portion 26 may be formed from a fiber composite material. For example purposes only, one example composite barrel portion 26 may be manufactured by rolling multiple layers of parallelogram-shaped pieces of pre-preg, each layer having a height of about 0.005 inches (0.127 mm), onto a mandrel, thereby making a tube with an outer diameter appropriately sized for a ball bat barrel portion. The parallelograms can be rolled up such that each layer has a butt joint with itself and such that on one end all the layers stop at the same longitudinal station but on the other end, each layer can be about one centimeter shorter than the previous layer, creating a tapered end 16. In one implementation, the layers are angled +/−37 degrees from the longitudinal with each layer orientated at a negative angle to the previous layer. In other implementations, other lay-ups of composite materials with other angles and combinations of angles can be used. In still other implementations, barrel portion 26 can be formed of other materials, such as, for example, other alloys, wood, and combinations thereof.

Barrel portion 26 comprises distal region 34 and proximal region 36. In the example illustrated, distal region 34 has a generally constant diameter while proximal region 36 tapers inwardly from distal region 34 towards knob 22 and towards the outer surface of handle portion 24. In other implementations, distal region 34 and proximal region 36 may have other configurations. For example, the diameter of the barrel portion 26 may taper inward and/or outward continuously along its length.

The barrel portion 26 and handle portion 24 are capable of moving relative to each other about the pivot joints 40, 50, which are capable of dampening shock and vibration. Pivot joint 40 (schematically illustrated) movably supports proximal region 36 of barrel portion 26 for movement relative to axis 32. In the example illustrated, pivot joint 40 pivotably supports proximal region 36 for movement relative to axis 32 and for movement relative to handle portion 24. Upon impact with a ball with the barrel portion 26 at or near pivot joint 40, pivot joint 40 facilitates pivoting and deflection of proximal region 36 of barrel portion 26 about an axis that is perpendicular to axis 32.

Figure 15:
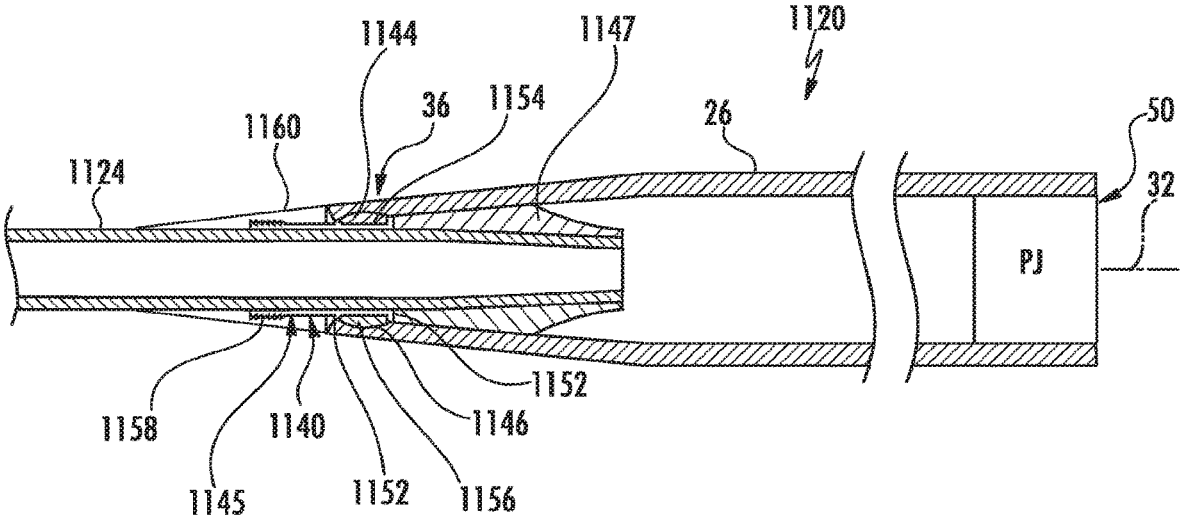
FIG. 15 is a longitudinal cross-sectional view of a portion of another example bat.

In one implementation, pivot joint 40 comprises a curved or annular socket formed into, or connected to, one of handle portion 24 and barrel portion 26 and a rounded head received within the curved or annular socket and connected to the other of handle portion 24 and barrel portion 26. In one implementation, as shown in FIG. 15 and discussed below, a metal sleeve or handle interface piece can be positioned over the handle to couple the pivot joint 40 to the handle portion 24. In one implementation, the curved or annular socket extends completely and continuously about axis 32. In another implementation, the curved or annular socket partially curves or extends about axis 32. In one implementation, pivot joint 40 may close off or occlude the proximal opening 42 of barrel portion 26, the annular volume or space between an interior of proximal region 36 of barrel portion 26 and the exterior surface of handle portion 24.

Pivot joint 50 (schematically illustrated) movably supports distal region 34 of barrel portion 26 relative to axis 32. In the example illustrated, pivot joint 50 pivotably supports distal region 34 of barrel portion 26 relative to axis 32. In one implementation, the pivot joint 50 is coupled to the distal region 34 of the barrel portion 26 by a tubular insert. The tubular insert can be formed of a plastic, a metal or other generally rigid material. Upon impact with a ball with the barrel portion 26 at or near pivot joint 50, pivot joint 50 facilitates pivoting and deflection of distal region 34 of barrel portion 26 about an axis that is perpendicular to axis 32. Pivot joint 50 cooperates with pivot joint 40 to pivotally support both ends of barrel portion 26, facilitating deflection of those regions between pivot joints 40 and 50 during impact with a ball. As a result, the hitting performance of the barrel can be enlarged and/or improved, particularly in locations of the barrel portion 26 at or near one or both of the pivot joints 40 and 50. In most conventional ball bats, the regions of the barrel portion adjacent the end cap of the bat or the region that is connected to, or continuous with, the handle portion, typically produce or provide limited or significantly reduced performance when impacting a ball at those locations. The present invention significantly improves the hitting performance (coefficient of restitution, trampoline effect, and feel) of the bat at or near those regions of the bat. Further, implementation of the first and second pivot joints serves to improve the performance of the barrel portion of the bat as a whole.

In one implementation, pivot joint 50 comprises a curved or annular socket connected to one of handle portion 24 and barrel portion 26 and a rounded head received within the curved or annular socket and connected to the other of handle portion 24 and barrel portion 26. In one implementation, the curved or annular socket extends completely and continuously about axis 32. In another implementation, the curved or annular socket partially curves or extends about axis 32. In one implementation, pivot joint 50 may be part of a structure or of the end cap that closes off or occludes the distal opening 52 of barrel portion 26. In yet other implementations in which handle portion 24 terminates prior to reaching distal region 34 of barrel portion 26 or is actually spaced from pivot joint 50, pivot joint 50 may be self-supporting, independent of handle portion 24. For example, as will be described hereafter, in some implementations, pivot joint 50 may comprise an end cap or other structure that extends about the interior surfaces of barrel portion 26 at distal region 34.

Transitioner 60 comprises a structure or a collection of multiple structures that provide a smooth transition from the larger diameter of the proximal region 36 of barrel portion 26 to the smaller diameter outer surface of handle portion 24. In one implementation, transitioner 60 comprises a conical sleeve extending about handle portion 24 insubstantial abutment with proximal edges of barrel portion 26. In yet another implementation, transitioner 60 comprises multiple components that collectively form a conical structure about handle portion 24 and in abutment with the proximal edge of barrel portion 26. In some implementations, transitioner 60 may be omitted. For example, in some implementations, barrel portion 26 may itself taper down to handle portion 24. In yet other implementations, a shoulder may exist between barrel portion 26 and handle portion 24. The transitioner 60 may be formed as primarily a cosmetic or aesthetic component of the bat. In other implementations, the transitioner can provide some degree of structural support, or provide mechanical dampening, to the bat or a pivot joint.

Figure 3:
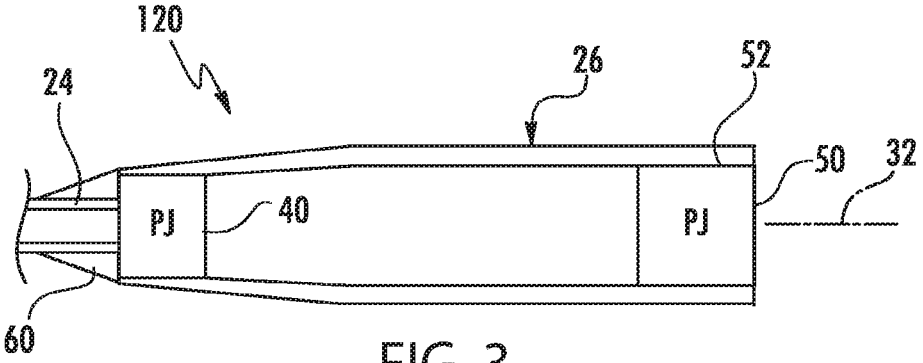
FIG. 3 is a fragmentary sectional view of a portion of another example bat.

FIG. 3 is a sectional view of bat 120, example implementation of bat 20. Bat 120 is similar to bat 20 except that handle portion 24 terminates prior to reaching pivot joint 50 such that pivot joint 50 is retained and supported independent of handle portion 24. In the example illustrated, handle portion 24 of bat 120 is connected to proximal region 36 of barrel portion 26 by pivot joint 40. The distal region of handle portion 24 is connected to pivot joint 40, whereas pivot joint 40 is connected to proximal region 36 of barrel portion 26. Pivot joint 50 occludes or closes distal opening 52 of barrel portion 26. In the example illustrated, the interior barrel portion 26 between pivot joint 40 and pivot joint 50 is hollow or unfilled by a pivot joint.

Figure 4:
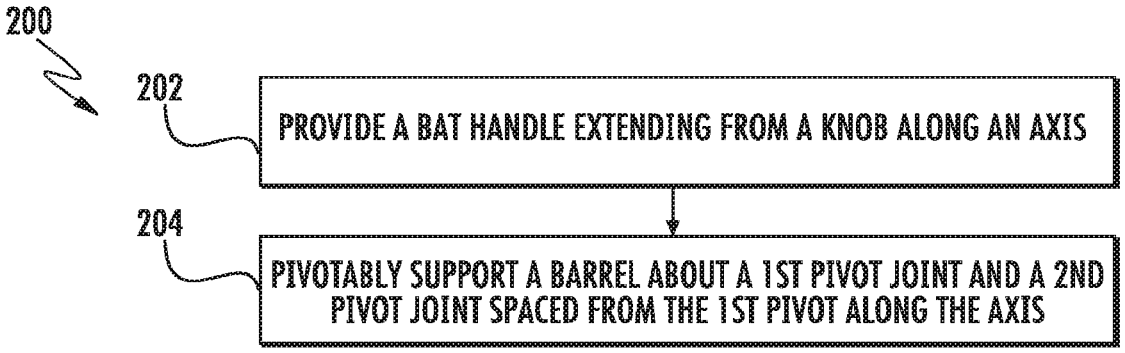
FIG. 4 is a flow diagram of an example method for forming an example bat.

FIG. 4 is a flow diagram of an example method 200 for forming a bat, such as bat 20 or bat 120 described above. As indicated by block 202, a bat handle portion extending from a knob along an axis is provided. As indicated by block 204, a barrel portion is pivotally supported about a first pivot joint and a second pivot joint spaced from the first pivot joint along the axis.

Figure 5:
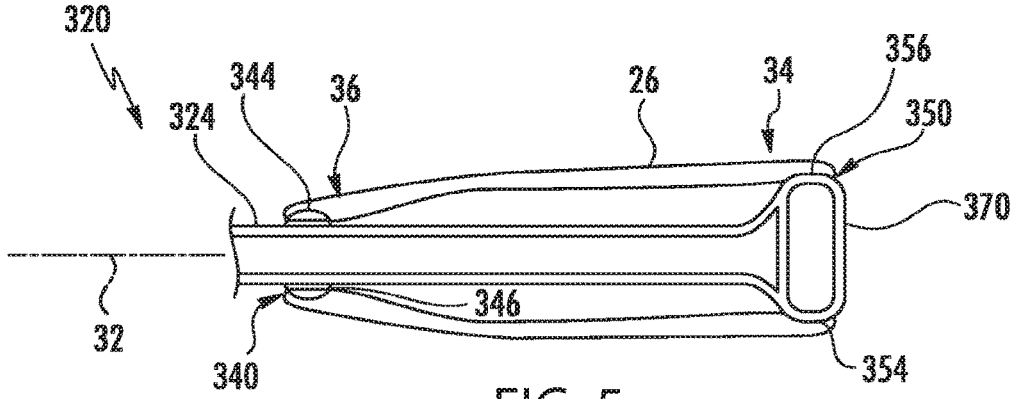
FIG. 5 is a fragmentary sectional view of a portion of another example bat.

FIG. 5 is an enlarged fragmentary sectional view of another example back 320, an example implementation of bat 20. Bat 320 similar to bat 20 except that bat 320 comprises handle portion 324 and is specifically illustrated as comprising pivot joints 340 and 350. Those remaining components of bat 320 which correspond to components of bat 20 or 120 are numbered similarly or are shown in FIGS. 1-3.

Handle portion 324 is similar to handle portion 24 except that handle portion 324 extends to and is connected to enlarged bulbous structure that also forms or serves as an end cap 370 for bat 320. End cap 370 is integrally formed as a single unitary body with handle portion 324. End cap 370 is contained within distal region 34 of barrel portion 26 such that distal region 34 overlays portions of end cap 370.

Pivot joint 340 is formed directly between proximal region 36 of barrel portion 26 and exterior surface of handle portion 324. In the example illustrated, pivot joint 340 comprises annular socket 344 and an annular rounded head 346 received within annular socket 344. In the example illustrated, annular socket 344 is provided by proximal region 36 of barrel portion 26 and rounded head 346 is provided on the exterior of handle portion 324. Rounded head 346 movable, slidably and/or rotatable engaged with socket 344, allowing proximal region 36 of barrel portion 26 to rotate or pivot about an axis (or axes) perpendicular to centerline 32 of bat 320 upon impact of a ball with the barrel portion 26. In other implementations, and annular socket 344 may be provided on the exterior of handle portion 324, facing outwardly, while rounded head 346 can be formed on the inner surface of proximal region 36 of barrel portion 26, facing and received within annular socket 344. In the example illustrated, both annular socket 344 and annular rounded head 346 completely and continuously encircle the axis or centerline 32. In another implementation, annular socket 344 and annular rounded head 346 may comprise multiple angularly spaced segments about axis 32.

Pivot joint 350 is formed by distal region 34 of barrel portion 26 and end cap 370. In the example illustrated, pivot joint 350 comprises annular socket 354 and an annular rounded head 356 of end cap 370 is received within annular socket 354. In the example illustrated, annular socket 354 is provided by distal region 34 of barrel portion 26 and rounded head 356 is provided on the circumferential perimeter of end cap 370. Rounded head 356 is movable, slidable and/or rotatable within socket 354, allowing distal region 34 of barrel portion 26 to rotate or pivot about an axis (or axes) perpendicular to centerline 32 of bat 320. In other implementations, annular socket 354 may be provided on the circumferential perimeter of end cap 370, facing outwardly, while rounded head 356 is formed on the inner surface of distal region 34 of barrel portion 26, facing and received within annular socket 344. In the example illustrated, both annular socket 354 and annular rounded head 356 completely and continuously encircle the axis or centerline 32. In another implementation, annular socket 354 and annular rounded head 356 may comprise multiple angularly spaced segments about axis 32. Because end cap 370 is integrally formed as a single unitary body with handle portion 324, both of such components may be simultaneously fabricated and assembled to barrel portion 26, providing simpler construction of bat 320.

Figure 6:
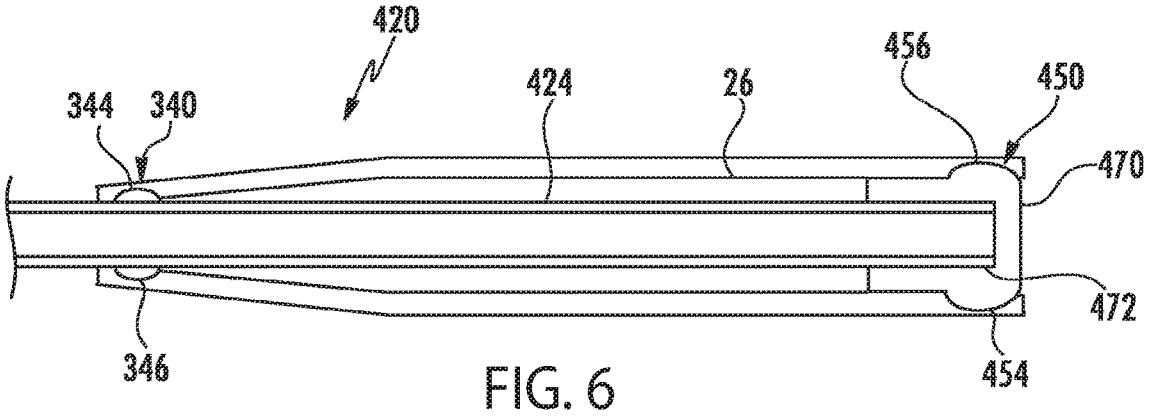
FIG. 6 is a fragmentary sectional view of a portion of another example bat.

FIG. 6 is an enlarged fragmentary sectional view of another example bat 420, an example implementation of bat 20. Bat 420 similar to bat 320 except that bat 420 comprises handle portion 424, end cap 470 and is specifically illustrated as comprising pivot joint 450. Those remaining components of bat 420 which correspond to components of bat 320 or bat 20 are numbered similarly or are shown in FIGS. 1-5.

Handle portion 424 is similar to handle portion 24 except that handle portion 424 is attached to end cap 470 for bat 420. Handle portion 424 has uniform diameter along its length to a distal end 472 received within end cap 470. In other implementations, distal end 472 may include an axial opening that receives a portion of end cap 470. End cap 470 is similar to end cap 370 except that end cap 470 is mounted to distal end 472 of handle portion 424. As a result, handle portion 424 may be more easily fabricated, such as a pultrusion, or other single diameter tubular body.

Pivot joint 450 is formed directly by distal region 34 of barrel portion 26 and end cap 470. In the example illustrated, pivot joint 450 comprises annular socket 454 and an annular rounded head 456 received within annular socket 454. In the example illustrated, annular socket 454 is provided by distal region 34 of barrel portion 26, and rounded head 456 is provided on the circumferential perimeter of end cap 470. Rounded head 456 is movable, slidable and/or rotatable within socket 454, allowing distal region 34 of barrel portion 26 to rotate or pivot about an axis (or axes) perpendicular to centerline 32 of bat 420. In other implementations, annular socket 454 may be provided on the circumferential perimeter of end cap 470, facing outwardly, while rounded head 456 is formed on the inner surface of distal region 34 of barrel portion 26, facing and received within annular socket 454. In the example illustrated, both annular socket 454 and annular rounded head 456 completely and continuously encircle the axis or centerline 32. In another implementation, annular socket 454 and annular rounded head 456 may comprise multiple angularly spaced segments about axis 32. Because end cap 470 is mounted to handle portion 424, both of such components may be individually fabricated and assembled together, reducing fabrication cost and complexity for each part.

Figure 7:
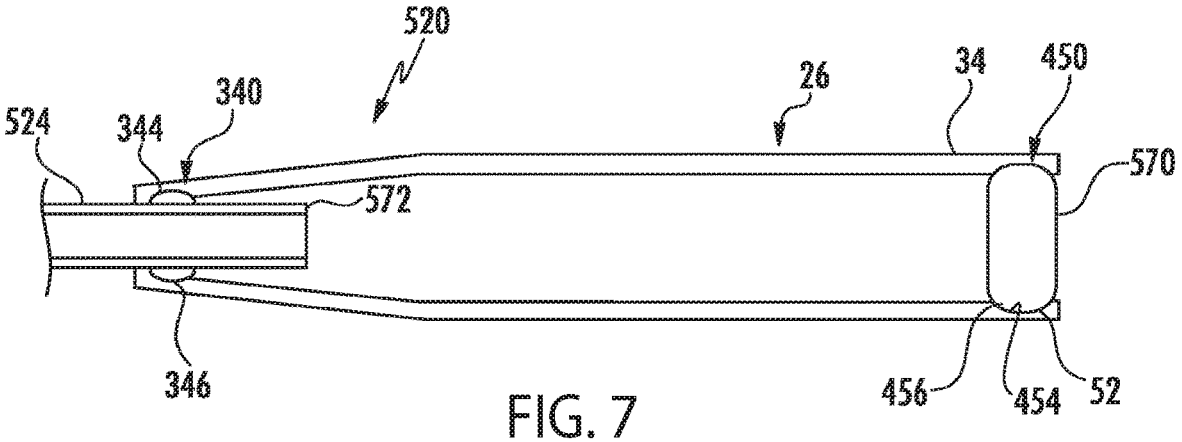
FIG. 7 is a fragmentary sectional view of a portion of another example bat.

FIG. 7 is an enlarged fragmentary sectional view of another example bat 520, an example implementation of bat 20. Bat 520 similar to bat 320 except that bat 520 comprises handle portion 524 and end cap 570. Those remaining components of bat 520 which correspond to components of bat 320 or bat 20 are numbered similarly or are shown in FIGS. 1-5.

Handle portion 524 is similar to handle portion 24 except that handle portion 524 terminates prior to reaching end cap 570. Handle portion 524 has uniform diameter along its length to a distal end 572 received within barrel portion 26. In one implementation, the distal end 572 of handle portion 524 can terminate in a tapered intermediate region of the barrel portion 26. In other implementations, the distal end 572 can terminate immediately following the rounded head 346, or any position along the longitudinal axis toward, but not extending to, the end cap 570.

End cap 570 is similar to end cap 470 except that end cap 570 comprises a disk that occludes distal opening 52 of barrel portion 26. In the example illustrated, the disk forming the end cap 570 is within and is overlapped by distal region 34 of barrel portion 26. In the example illustrated, the outer circumferential perimeter of end cap 570 provides the annular rounded head 456 while the inner surface of distal portion 34 provides the inner annular groove 454 of pivot joint 450. In other implementations, the outer circumferential perimeter of end cap 570 may alternatively comprise an outer annular groove or socket 454 of pivot joint 450 while the inner circumferential surface of distal portion 34 of barrel portion 26 comprises the annular rounded head 456 of pivot joint 450.

Figure 8:
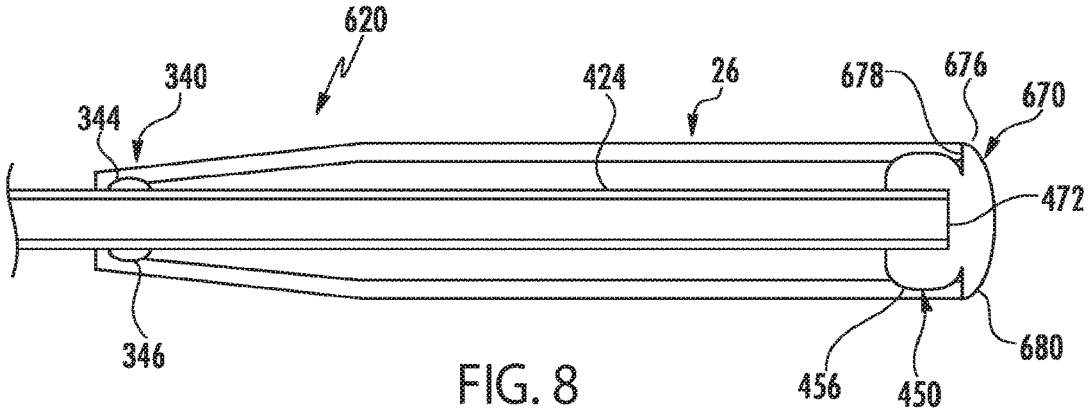
FIG. 8 is a fragmentary sectional view of a portion of another example bat.

FIG. 8 is an enlarged fragmentary sectional view of another example bat 620, an example implementation of bat 20. Bat 620 similar to bat 420 except that bat 620 comprises end cap 670. Those remaining components of bat 620 which correspond to components of bat 420 or bat 20 are numbered similarly or are shown in FIGS. 1-6.

End cap 670 is similar to end cap 470 in that end cap 670 receives distal end 472 of handle portion 424. End cap 670 is different from end cap 470 in that end cap 670 additionally comprises a cover portion or lip 676. Lip 676 radially projects away from axis 32 so as to extend across, cover and overlie distal edges 678 of barrel portion 26. Lip 676 protects distal edges 678 of barrel portion 26. In one implementation, lip 676 is formed from an elastomeric material. In other implementations, other materials or combinations of materials can be used to make the end cap. In one implementation, lip 676 is connected to the distal edges 678 of barrel portion 26, but flexes so as to permit to pivoting of pivot joint 450 about an axis (or axes) perpendicular to axis 32, about rounded head 456, in response to the impact of a ball against barrel portion 26. In the example illustrated, lip 676 has a rounded perimeter 680. In other implementations, perimeter 680 may be tapered or may have other shapes. In another implementation, the handle portion 424 may terminate after the first pivot joint 340 and not extend to the end cap 670.

Figure 9:
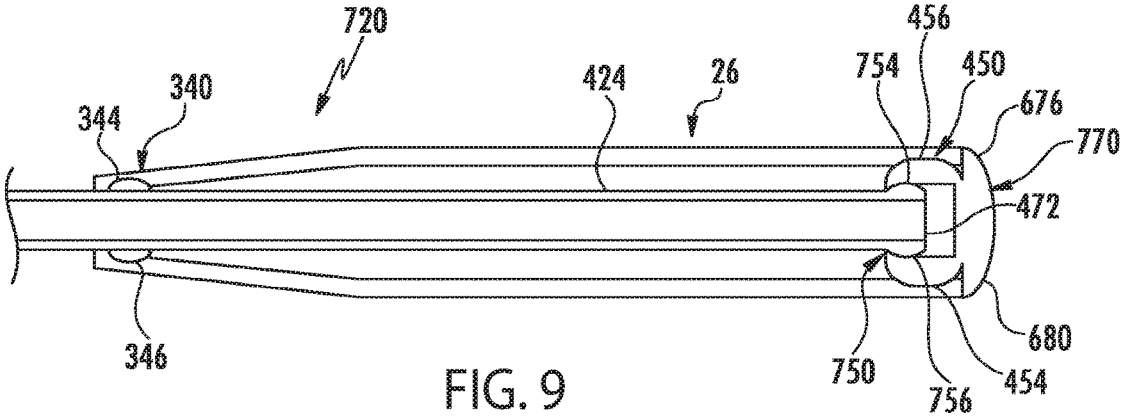
FIG. 9 is a fragmentary sectional view of a portion of another example bat.

FIG. 9 illustrates bat 720, another example implementation of bat 20. Bat 720 similar to bat 620 except that bat 720 additionally comprises pivot joint 750. Those remaining components of bat 720 which correspond to components of bat 620 or bat 20 are numbered similarly or are shown in FIGS. 1-2 and 8.

Pivot joint 750 is formed directly by an interior of end cap 770 and exterior surface of handle portion 424. In the example illustrated, pivot joint 750 includes annular socket 454 formed into the distal region of the barrel portion 26 and annular rounded head 456 formed by outer peripheral surfaces of end cap 770 (essentially incorporating pivot joint 450). Pivot joint 750 also comprises annular socket 754 and an annular rounded head 756 received within annular socket 754. In the example illustrated, annular socket 754 is provided by an interior portion of end cap 770 and rounded head 756 is provided on the exterior of handle portion 424 adjacent distal end 472. Rounded head 756 is movable, slidable and/or rotatable within socket 754, further allowing distal region 34 of barrel portion 26 to rotate or pivot about an axis (or axes) perpendicular to centerline 32 of bat 320. In other implementations, annular socket 754 may be provided on the exterior of handle portion 424 adjacent distal end 472, facing outwardly, while rounded head 756 is formed on the inner surface of end cap 770, facing and received within annular socket 754. In the example illustrated, both annular socket 754 and annular rounded head 756 completely and continuously encircle the axis or centerline 32. In another implementation, annular socket 754 and annular rounded head 756 may comprise multiple angularly spaced segments about axis 32. Pivot joint 750 essentially combines a pair of radially spaced apart annular sockets 454 and 754 with a pair of annular rounded heads 456 and 756.

Figure 10:
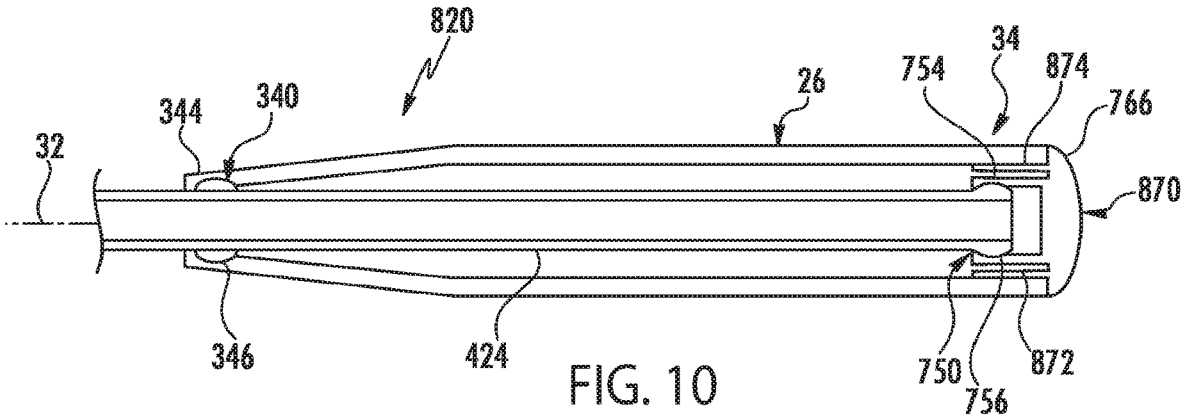
FIG. 10 is a fragmentary sectional view of a portion of another example bat.

FIG. 10 illustrates bat 820, another example implementation of bat 20. Bat 820 is similar to bat 720 except that bat 820 comprises end cap 870 and omits pivot joint 450, utilizing pivot joint 750 to facilitate pivoting of the distal region 34 of barrel portion 26 during impact with a ball. Those remaining components of bat 820 which correspond to components of bat 720 or bat 20 are numbered similarly or are shown in FIGS. 1-2 and 9.

End cap 870 caps the end of barrel portion 26 the same time permitting barrel portion 26 to pivot about pivot joint 750 when impacted by a ball. End cap 870 comprises an annular ring 872 that fits inside distal region 34 of barrel portion 26 and abuts the inner circumferential surfaces 874 of distal region 34 of barrel portion 26 to secure end cap 870 to barrel portion 26. In one implementation, ring 872 frictionally engages the inner surfaces 874 of barrel portion 26 to retain end cap 870 in place. In another implementation, ring 872 is glued, bonded, welded, fastened or snapped to surface 874 of barrel portion 26. In the example illustrated, ring 872 is formed from a resiliently flexible material, being sufficiently flexible to allow bat 26 to pivot about an axis perpendicular to centerline 32 as facilitated by pivot joint 750.

Figure 11:
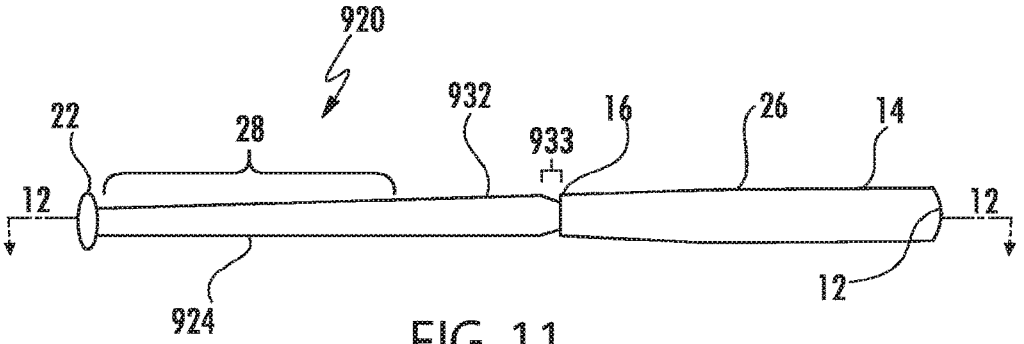
FIG. 11 is a side view of another example bat.
Figure 12:
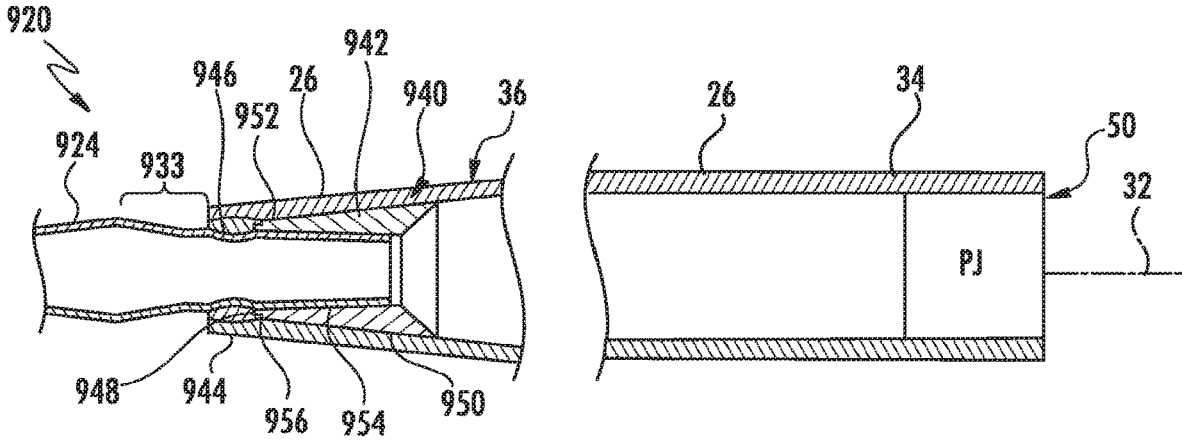
FIG. 12 is a fragmentary sectional view of a portion of the bat of FIG. 11.

FIGS. 11 and 12 illustrate bat 920, another example implementation of bat 20. Bat 920 is similar to bat 20 described above except that bat 920 is specifically illustrated as comprising handle portion 924, pivot joint 940 and wedge 942. Those remaining components of bat 920 which correspond to points of bat 20 are numbered similarly. Bat 920 also includes a second pivot joint, such as pivot joint 50, 350 or 450, position at the distal region 34 of the barrel portion 26 and the end cap, such as end cap 370, 470, 570, 670, 770 or 870.

Handle portion 924 is similar to handle portion 24 except that handle portion 924 comprises a distal region 932 that initially expands as handle portion 924 extends towards barrel portion 26 and then tapers inwardly in the region 933 as handle portion 924 extends into barrel portion 26. In yet other implementations, handle portion 924 may have a constant diameter along its length.

Pivot joint 940 pivotably supports proximal region 36 of barrel portion 26 for pivotal movement about an axis perpendicular to the centerline 32 of bat 920. Pivot joint 940 cooperate with pivot joint 50 (schematically illustrated) to facilitate inward deflection of barrel portion 26 when impacting a ball, enhancing or improving the performance of the barrel portion and the hitting zone of the ball bat.

As shown in FIG. 12, pivot joint 940 comprises an annular socket 944 and an annular rounded head 946 which is movably received within socket 944. In the example illustrated, socket 944 is formed along the inner surface of barrel portion 26 while rounded head 946 is provided on the exterior of handle portion 924. In other implementations, this arrangement may be reversed.

In one implementation, socket 944 is pre-molded into a generally toroidal shape with a central channel or groove sized to snugly accept the rounded head 946 of handle portion 924. In one embodiment, the socket 944 has an outer diameter of about 1.25 inches (3.18 cm), an inner diameter of about 0.87 inches (2.29 cm), and a length of about 0.55 inches (1.40 cm). The outer curve of the socket 944 is a segment of a circle with a diameter of 1.26 inches (3.20 cm). The inner curve of the socket 944 is a segment of a circle with a diameter of 0.98 inches (2.49 cm). The height of the socket varies from about 0.19 inches (4.83 mm) at the center to about 0.07 inches (1.78 mm) at the edges. In the example illustrated by FIG. 12, the socket 944 includes a notch 948. The notch 948 has a length of about 0.1 inches (2.54 mm) and a height of about 0.04 inches (1.02 mm). The socket 944 may be made of any suitable material, such as, for example, a hard nylon.

Wedge 942 comprises a structure extending between the outer circumference of handle portion 924 and the inner circumference of barrel portion 26. In one implementation, wedge 942 pre-molded into a truncated, generally conical shape having a large diameter end 950 and a small diameter end 952. The wedge 942 includes a central channel 954 sized to snugly accept the handle portion 924. In the example shown in FIG. 12, the tapered proximal region 36 of the barrel portion 26 includes a notch 956 for facilitating retention and proper positioning of rounded head 946 and wedge 942.

In one implementation, the length of the wedge 942 is about 2 inches (5.08 cm). The small diameter end 952 of wedge 942 has a diameter of about 1.1 inches (2.79 cm). The diameter of the wedge 942 remains constant for a length of 0.1 inches (2.54 mm), extending over the length of the notch 40, and then increases along a curve with a radius of 0.05 inches (1.27 mm) to a diameter of 1.2 inches (3.05 cm). The diameter of the wedge 942 then increases at a 6.5 degree angle to a diameter of about 1.70 inches (4.32 cm) at the large diameter end 950. The central channel 954 has a 1 inch (2.54 cm) diameter at the small diameter end 952, which decreases in diameter at a 5 degree angle for a length of about 0.57 inches (1.45 cm) to a diameter of 0.9 inches (2.29 cm). The central channel 42 maintains a constant diameter of 0.9 inches (2.29 cm) for a length of about 1.08 inches (2.74 cm), then increases in diameter at a 45 degree angle for a length of about 0.35 inches (8.9 mm) to the large diameter end 36. In other implementations, the wedge 942 can be formed of other shapes and/or sizes. In this embodiment, the outer surface of the wedge 942 corresponds with the inner surface of the transition region 933 of the ball bat 920. The wedge 942 may be made of any suitable material, such as, for example, rubber, or preferably, ethylene propylene diene monomer ("EPDM") rubber with a hardness between 40-50 Shore A, ideally about 45 Shore A. In other implementations, the wedge 942 can be formed of other materials, such as a polymeric foam, and can be formed of other hardness values.

In one implementation, the pivot joint 940 is made by attaching the socket 944 to the small diameter end 952 of the wedge 942 such that the handle portion 924 fits inside the central channel 954 of the socket 944 and the central channel 954 of the wedge 942. The wedge 942 may be secured to the socket 944 by any suitable method, such as, for example bonding with an adhesive.

In another implementation, handle portion 924 can be formed as a substantially constant diameter hollow tube. The handle portion 924 may be manufactured using common manufacturing techniques.

For example purposes only, a composite handle portion 924 may be made by rolling at least one flat sheet of pre-impregnated composite fiber ("pre-preg") around a mandrel, thereby making a tube with an outer diameter appropriately sized for a ball bat handle portion. In a preferred embodiment, the sheet of pre-preg comprises two layers of graphite pre-preg with fibers angled +/−15 degrees from the longitudinal with one layer orientated at a negative angle to the other layer. Two layers of pre-preg with a height of about 0.005 inches (0.127 mm) and fibers angled 90 degrees from the longitudinal are wrapped around the last 7.87 inches (20.0 cm) of the handle portion 924 at the end opposite the knob 22. In other implementations, other composite materials or other materials can be used to form the handle portion.

For example purposes only, a composite barrel portion 26 may be manufactured by spirally rolling 24 layers of high aspect ratio parallelogram-shaped pieces of pre-preg, each layer having a height of about 0.005 inches (0.127 mm), on a rolling mandrel with the fibers oriented longitudinally, thereby making a tube with an outer diameter appropriately sized for a ball bat barrel portion. A finishing mandrel includes a constant diameter section and a tapered section. After being rolled up, the barrel portion 26 is transferred to the constant diameter section of the finishing mandrel. The socket assembly 940 is temporarily attached to the finishing mandrel by affixing the large diameter end 950 of the wedge 942 to the end of the tapered section of the finishing mandrel. Latex banding about one inch (2.54 cm) wide and 0.05 inches (1.27 mm) high is wrapped around the tapered end 16 of the barrel portion 14. The proximal region 36 is then slowly drawn down the tapered section of the finishing mandrel, over the wedge 942 and over the socket 944, such that the proximal region 36 stops at the same longitudinal station as the socket 944. The latex banding is then removed and ribbons of pre-preg about 0.5 inches (1.27 cm) wide are wound around the lay-up directly above the pivot joint 940, forming a thickness of about 20 layers of pre-preg, each layer having a height of about 0.005 inches (0.127 mm). By being formed directly over the pivot joint 940, the inner surface of the barrel portion 26 is contoured to retain pivot joint 940.

The barrel portion 26 is removed from the finishing mandrel and a portion of the handle portion 924 is inserted. The handle portion 924 contacts the socket 944 and wedge 942 of the pivot joint 940, but does not contact the barrel portion 26, as shown in FIG. 12. The handle portion 924 is retained within the socket 944 and wedge 942 by mechanical interference. In some embodiments, the handle portion 924 may be attached to the wedge 942, such as, for example, by bonding with an adhesive. The barrel portion 26 and handle portion 924 are capable of moving relative to each other about the socket 944, which dampens shock and vibration. The wedge 942 is located between the barrel portion 26 and handle portion 924, restricting the relative movement between the handle portion 924 and barrel portion 26. The degree of restriction of relative movement between the handle portion 924 and barrel portion 26 can be controlled by selecting the thickness of the wedge 942 and the material from which the wedge 942 is constructed.

The exterior surfaces of the barrel portion 26 and handle portion 924 do not provide a substantially continuous and smooth surface for the outer surface of the transition region 933. Instead, a generally triangular shaped notch is formed in the transition region 933 of the ball bat 920. The notch 933 is perpendicular to the long axis of the ball bat 920 and formed at a station whereby the notch 933 is adjacent to the socket 944. The notch 933 has a maximum depth of about 0.25 inches (6.35 mm) adjacent to the socket 944, with the depth of the notch 933 decreasing in the direction of the knob 22. The notch 933 allows for greater relative movement between the handle portion 924 and the barrel portion 26.

An inflatable bladder is inserted into the ball bat 920 assembly and a standard knob 22 is applied using techniques common in the industry. The bladder is inflated, expanding the barrel portion 26 and handle portion 924. The expansion of the handle portion 924 causes the outer surface of the handle portion 924 to conform to the inner surface of the socket 944 and wedge 950. In particular, the handle portion 924 forms a concave "saddle" shape conforming to the inner surface of the socket 944 which mechanically locks the handle portion 924 within the barrel portion 26. The assembly then is placed into a ball bat-shaped mold under pressure and heated to cure the ball bat, using standard techniques known in the art. Both the handle portion 924 and barrel portion 26 are cured at the same time, consequently only one composite cure cycle is utilized for the ball bat 920.

Figure 13:
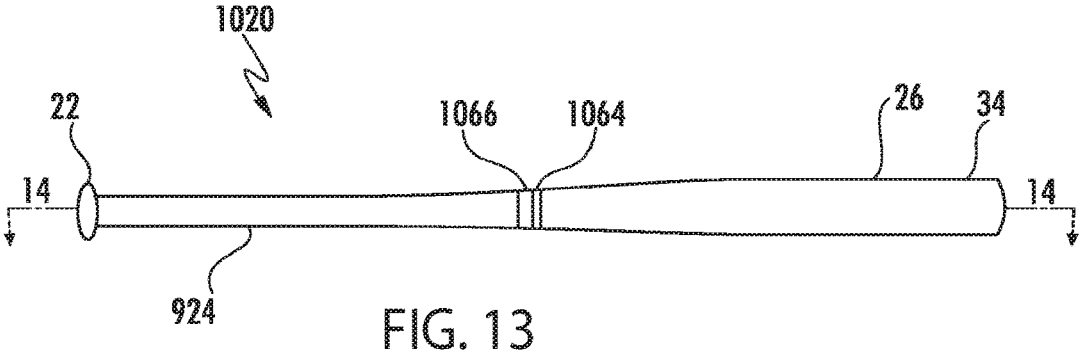
FIG. 13 is a side view of another example bat.
Figure 14:
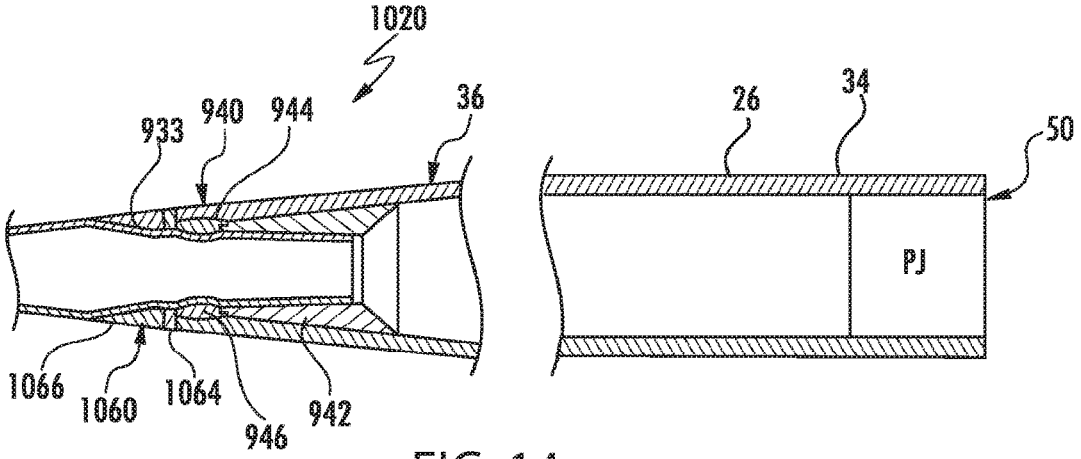
FIG. 14 is a fragmentary sectional view of a portion of the bat of FIG. 13.

FIGS. 13 and 14 illustrate bat 1020, another example implementation of bat 20. That 1020 is similar to bat 920 except that bat 1020 additionally comprises transitioner 1060. Those remaining components of bat 1020 which correspond to components of bat 920 are numbered similarly.

Transitioner 1060 comprises ring 1064 and filler material 1066. Ring 1064 coaxially placed around the handle portion 924, in the notch 933, such that the ring 1064 abuts the socket 944 and the proximal region 36 of the barrel portion 26. The height of the ring 1064 is preferably equal to the depth of the notch 933 and the width of the ring is about 0.212 inches (5.38 mm). The ring 1064 may be made of any suitable material, such as, for example, rubber, or preferably, EPDM rubber with a hardness between 40-50 Shore A, ideally about 45 Shore A. In one implementation, the ring 1064 is constructed from the same material as the wedge 942. In yet other implementations, ring 1064 and wedge 942 are formed from different materials. For example, in one implementation, ring 1064 may be formed from a silicone rubber, whereas wedge 942 may be formed from an ethylene propylene diene monomer (EPDM) synthetic rubber, a thermoplastic polyurethane (TPU), a thermoplastic elastomer blends.

The ring 1064 acts cooperatively with the wedge 942 to restrict the relative movement between the handle portion 924 and barrel portion 26 about the socket 944. The degree of restriction of relative movement between the handle portion 20 and barrel portion 14 can be controlled by modifying the material from which the ring 1064 is constructed. The remaining volume of the notch 933 may be filled with a fill material 1066, such as, for example, adding sufficient pre-preg to fill the remaining volume of the notch 933 before the cure cycle. In this preferred second embodiment, the notch 933 is filled by ring 1064 and fill material 1066 such that the barrel portion 26, ring 1064, fill material 1066, and handle portion 924, provide a substantially continuous and smooth exterior surface for the transition region of the ball bat 1020.

FIG. 15 illustrates bat 1120 another example implementation of bat 20. Bat 1120 comprises knob 22 (shown in FIG. 1), handle portion 1124, barrel portion 26 (shown in FIG. 1), pivot joint 1140, pivot joint 50 and transitioner 1160. Handle portion 1124 extends between knob 22 and barrel portion 26. In the example illustrated, handle portion 1124 has a constant outer diameter along a majority, if not all of its length. Handle portion 1124 projects into barrel portion 26. In other implementations, handle portion 1124 may have other configurations.

Pivot joint 1140 pivotably supports proximal region 36 of barrel portion 26 for pivotal movement about an axis perpendicular to the centerline 32 of bat 1120. Pivot joint 1140 cooperates with pivot joint 50 (schematically illustrated) to facilitate inward deflection of barrel portion 26 when impacting a ball, enhancing or improving the performance of the barrel portion and the hitting zone of the ball bat.

As shown in FIG. 15, pivot joint 1140 comprises an annular socket 1144, handle interface piece 1145, annular rounded head 1146 which is movably received within socket 1144 and damper 1147. In the example illustrated, socket 1144 is formed along the inner surface of barrel portion 26 while rounded head 1146 is coupled to the exterior of handle portion 1124. In other implementations, this arrangement may be reversed.

Handle interface piece (HIP) 1145 comprises a component that is bonded to the outer diameter an outer surface of handle portion 1124. HIP 1145 interconnects handle portion 1124 to barrel portion 26. In the example illustrated, HIP 1145 comprises an a tube or sleeve having a pair of spaced walls 1152 that form an intermediate channel 1154 that contains a ring 1156 having an outer rounded surface forming head 1146. In other implementations, ring 1156 may be secured to hip 1145 without being received within the intermediate channel 1154. For example, ring 1156 may be welded, bonded, mechanically snapped into or onto, or otherwise secured to HIP 1145. In some implementations, ring 1156 is omitted, wherein head 1146 is integrally formed as a single unitary body about along the exterior of HIP 1145.

In the example illustrated, the outer surface of HIP 1145 additionally includes a threaded portion 1158. Threaded portion 1158 threadably mates with corresponding threads on the interior of interface 1160. Similar to interface 60, interface 1160 provides a smooth transition between handle portion 1124 and barrel portion 26. In other implementations, HIP 1145 may omit threaded portion 1158, wherein interface 1160 is secured to handle portion 1124 and/or HIP 1145.

Damper 1147 comprises an elastomeric or resilient mass of material captured between handle portion 1124 and the interior diameter service of barrel portion 26 within barrel portion 26. In one implementation, damper 1147 comprises a mass of rubber or rubber-like material filling the volume between the proximal region 36 of barrel portion 26, mechanically coupled to or physically contacting the inner surface of barrel portion 26 and the outer surface of handle portion 1124. In one implementation, damper 1147 is formed by filling the volume between HIP 1145 and the end of handle portion 24 with elastomeric material or rubber-like material in a liquid like state, wherein the elastomeric or rubber-like material is subsequently dried or cured to a solid-state. In yet another implementation, damper 1147 is formed by securing a tubular rubber-like sleeve about the portion of handle portion 1124 that is received within barrel portion 26. Damper 1147 absorbs vibration and shock as barrel portion 26 pivots about one or both of pivot joint 1140 and pivot joint 50.

Although each of FIGS. 1-15 illustrate example bats in which each bat has a pivot joint proximate to both opposite ends of the barrel, each of such bats may alternatively comprise a single pivot joint at the distal end of the bat. Although each of FIGS. 1-15 illustrate bats which are multi-piece bats having distinct handle and barrel portions or members which are joined or secured to one another, in other implementations, each of such bats may alternatively be formed as "one piece" bat, a bat in which the handle and the barrel are integrally formed as a single unitary body. Such "one piece" bats may each have a single pivot joint or two opposite pivot joints.

Figure 16:
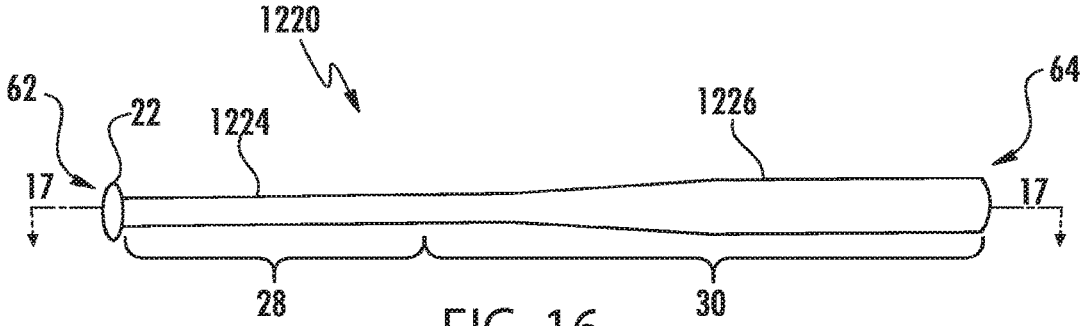
FIG. 16 is a side view of another example bat.
Figure 17:
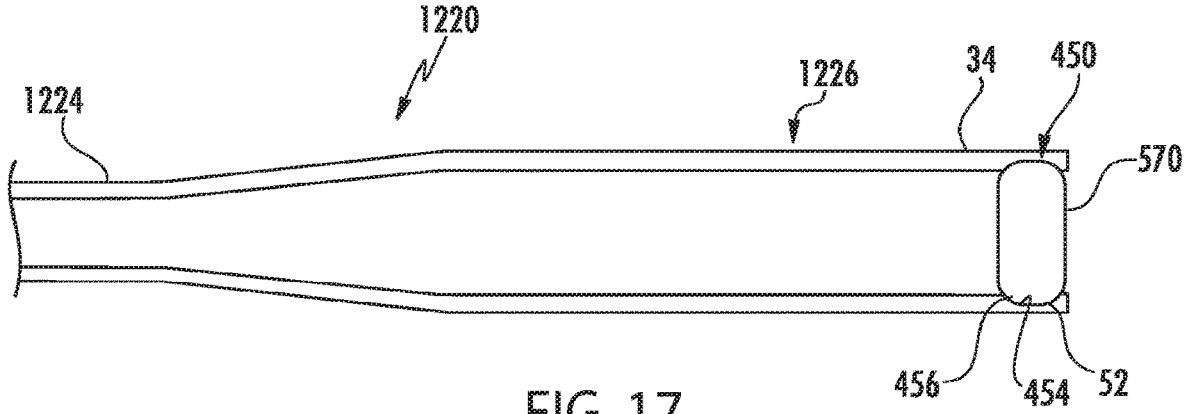
FIG. 17 is a fragmentary sectional view of a portion of the example bat of FIG. 16.

FIGS. 16 and 17 illustrate another example bat 1220. Bat 1220 is similar to bat 520 shown in FIG. 7 except that bat 1220 comprises a "one-piece" bat which a single member provides both the handle and the barrel of the bat. Those components of bat 1220 which correspond to components of bat 520 are numbered similarly.

As shown by FIG. 16, bat 1220 continuously extends from knob 22 to endcap 570 without interruption. As shown by FIG. 17, bat 1220 has a single outer layer that form both the handle portion 1224 and the barrel portion 1226 of bat 1220. In other words, bat 1220 has an integral one-piece frame. In other implementations, and a portion 1224 and barrel portion 1226 may be formed from multiple overlapping layers that continuously extend from knob 22 to endcap 570.

As further shown by FIG. 17, bat 1220 has a single pivot joint 450 at the distal and of the bat, the end of the bat most distant the knob 22. In the example illustrated, end cap 570 (described above with respect to bat 520) has a rounded circumferential periphery or head 454 that is movably received within an annular interior socket 456. As a result, the outer walls of barrel portion 1226 may pivot about head 454 during impact with a ball. The single pivot joint 450 is the only pivot joint within the bat 1220. The pivot joint movably supports the barrel portion relative to the longitudinal axis such that the distal region of the barrel portion may pivot towards and away from the longitudinal axis about the pivot joint.

Figure 18:
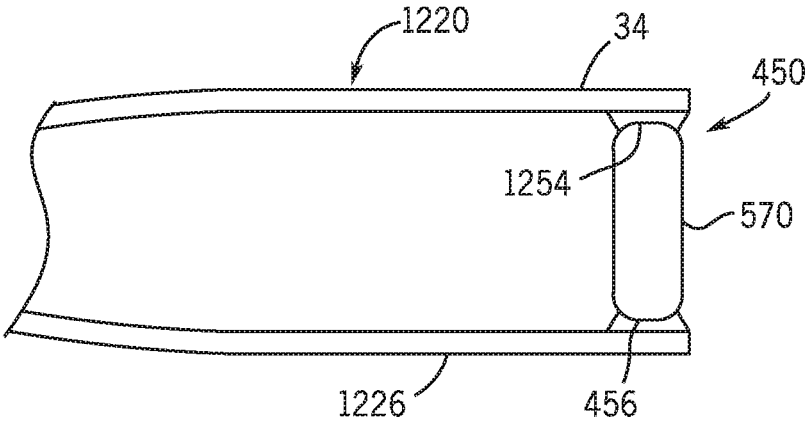
FIG. 18 is a fragmentary sectional view of a portion of another example bat of FIG. 16.

FIG. 18 illustrates another implementation of the present invention. Bat 1220 is a one-piece ball bat and the endcap 570 forms the pivot joint with an annular socket member 1254. The endcap 570 is positioned at the distal end of the barrel portion 1226. Unlike the example bat of FIG. 17, in FIG. 18 a distal region of the barrel portion 1226 has a generally constant wall thickness, and the annular socket member 1254 secured to the barrel portion 1226. In one implementation, the annular socket member 1254 can be secured to the barrel portion 1226 through an adhesive. In other implementations, other attachment mechanisms can be used including interference fit, molding, bonding and combinations thereof. The annular socket member 1254 includes a an annular groove that forms a socket 456 for engaging the curved periphery of the endcap 570. Under this implementation, the barrel portion 1226 and the annular socket member 1254 can pivot about and with respect to the peripheral head 454 of the endcap 570. In this implementation, the socket is formed in the annular socket member and not the distal end region of the barrel portion 1226. When a ball impacts the barrel portion 126, the barrel portion may pivot about the pivot joint formed by the endcap 570 and the annular socket member 1254. Upon such impact with the ball, the annular socket member 1254 may move independently with respect to the endcap 570. The annular socket member and the curved periphery of the endcap comprise the only pivot joint within the bat 1220.

Figure 19:
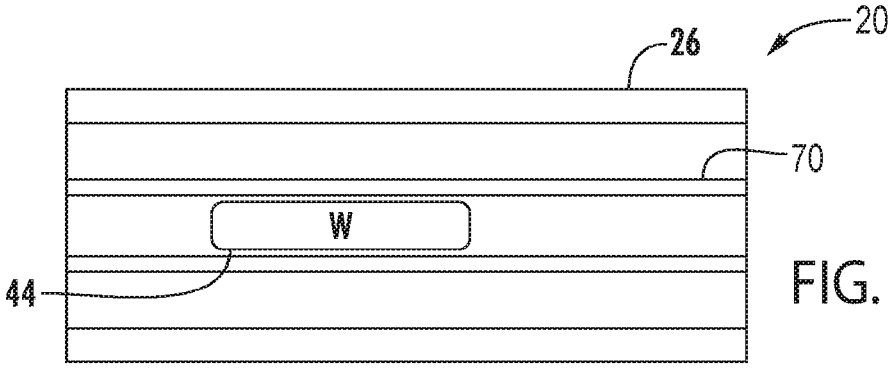
FIG. 19 is a fragmentary sectional view of a portion of another example bat of FIG. 1.

FIG. 19 is a sectional view of a portion of barrel portion 26 illustrating tube 70 and weight 44. Tube 70 extends within barrel portion 26 and supports weight 44. Tube 70 has outer surfaces radially spaced from the inner surfaces of barrel portion 26. In one implementation, tube 70 is supported in such spaced relationship to barrel portion 26 at a location proximate to distal end 34, such as by an endcap of bat 20. In another implementation, tube 70 is supported in such a spaced relationship to barrel portion 26 at a location proximate to the proximal end 36 of barrel portion 26. For example, in one implementation, tube 70 may be connected to handle portion 24. In another implementation, tube 70 may comprise an extension of handle portion 24, wherein tube 70 forms the core structure of handle portion 24.

In one implementation, tube 70 has a circular cross-section. In another implementation, tube 70 has an elliptical or polygonal cross sectional shape. In one implementation, tube 70 has a wall thickness of between 0.01 and 0.25 inch. In one implementation, tube 70 has an interior diameter of between 0.1 and 1.4 inches and an outer diameter of between 0.12 and 1.5 inches. In one implementation, tube 70 has a length of at least 3 inches. In one implementation, tube 70 extends along at least 3 inches of barrel portion 26. In one implementation, tube 70 extends along at least 10 percent of the axial length of barrel portion 26. In one implementation, tube 70 can extend from the end cap of bat 20. In another implementation, tube 70 can extend from the handle. In another implementation, tube 70 can extend from the proximal end 36 of bat. In one implementation, the thickness of the tube can vary along its length, such as a thin to thick, thick to thin, or other variable thickness configurations.

In one implementation, tube 70 may be formed in a fashion similar to handle portion 24. As indicated above, in some implementations, tube 70 may be formed concurrently with the forming of handle portion 24 as a single integral unitary body. In one implementation, tube 70 is formed of a strong, generally flexible, lightweight material, preferably a fiber composite material. Alternatively, tube 70 can be formed of other materials such as an aluminum alloy, a titanium alloy, steel, other alloys, a thermoplastic material, a thermoset material, wood or combinations thereof Weight 44 comprises a mass of material having a prescribed weight. In one implementation, weight 44 comprises an elongate solid plug positioned within tube 70. In yet another implementation, weight 44 may comprise hollow portions. In one implementation, weight 44 may have an outer cross sectional shape or profile that matches and corresponds to the cross-sectional inner shape or profile of tube 70. In one implementation, weight 44 has an axial length of between 0.1 and 10 inches.

In one implementation, weight 44 has a uniform density and/or uniform weight distribution in both longitudinal or axial directions and radial directions with respect to its centerline. In yet another implementation, weight 44 may have a non-uniform density and/or non-uniform weight distribution in at least one of the longitudinal/axial direction and radial direction with respect to its centerline. In one implementation, weight 44 may comprise multiple layers, wherein different layers have different densities and/or are formed from different materials so as to provide different weight distributions in the radial direction. In one implementation, weight 44 may comprise multiple axial segments having different densities and/or formed from different materials so as to provide different weight distributions in the axial a longitudinal direction. In some implementations, weight 44 may have a varying outer shape or outer diameter, wherein only portions of the outer surface of weight 44 are in contact with the inner surface of tube 70 and wherein the radially narrower portions have a lower weight as compared to the wider portions of weight 44.

Figure 20:
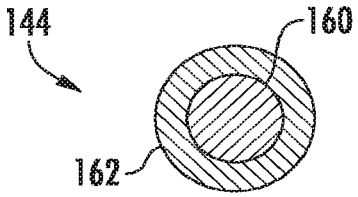
FIG. 20 is a sectional view of an example weight for the bat of FIG. 1.

FIG. 20 is a cross-sectional view of an example weight 144. Weight 44 comprises multiple layers, an inner layer or core 160 and an outer layer 162. Core 160 and outer layer 162 are formed from different materials having different weight densities. In one implementation, core 160 has a greater weight density as compared to layer 162. In another implementation, core 160 has a lighter weight density as compared to layer 162. In some implementations, core 160 may be omitted, wherein layer 162 has a hollow core.

Figure 21:
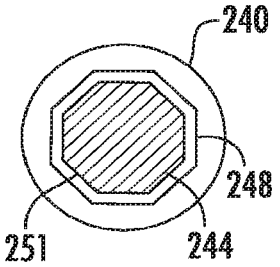
FIG. 21 is a sectional view of another example weight within another example inner tube of the bat of FIG. 1.

Although illustrated as having a circular cross-sectional shape, in other implementations, the weight 144 may have a noncircular or asymmetrical cross-sectional shape to further inhibit rotation of the weight relative to the tube. FIG. 21 is a sectional view illustrating another example tube 240 containing another example weight 244. Tube 240 has an asymmetric inner surface 248. Weight 244 has an outer surface 251 that has a shape or profile that matches the shape or profile of surface 248. As a result, rotation of weight 244 is inhibited. In the example illustrated, weight 244 has a polygonal cross sectional shape. In the example illustrated, weight 244 has an octagon shape. In one implementation, inner surface 248 may have other cross sectional shape such as an oval shape, an irregular shape or other polygonal shapes.

Figure 22:
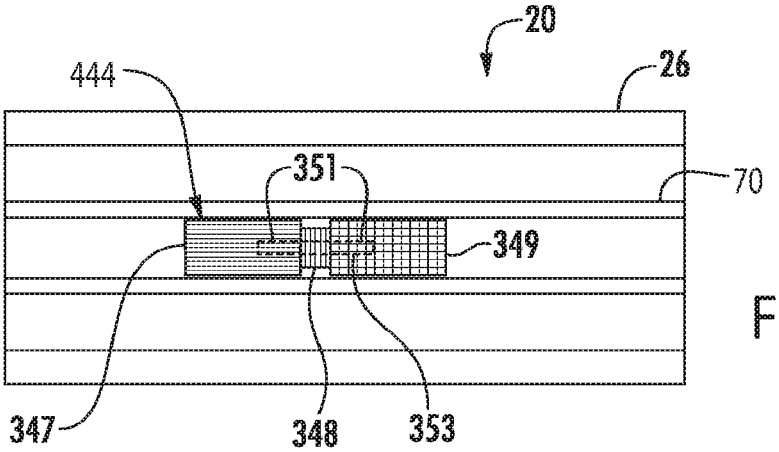
FIG. 22 is a sectional view of an example weight within an example inner tube of the bat of FIG. 1.

Although illustrated as being formed from a single member, in other implementations, weight 44 may be provided by multiple independent sections or segments mounted or otherwise secured to one another to provide adjustability for weight 44. FIG. 22 is a sectional view of a portion of barrel portion 26 illustrating tube 70 and weight 344, an example implementation of weight 44. Weight 344 is secured within tube 70 and comprises multiple interconnected segments, segments 347, 348 and 349. In the example illustrated, segments 347, 348, 349 are each formed from different materials having different weight characteristics. While segments 347 and 349 have the same shape and length, segments 348 is shorter and thinner. Segment 348 has an outer surface spaced from the inner surface of tube 70. The different materials and the different dimensions of segments 347, 348 and 349 provide weight 344 with a defined weight distribution or weight profile. In other implementations, other weights 344 may have other combinations of segments formed from different materials and/or having different dimensions as compared to one another.

In one implementation, segments 347, 348 and 349 are releasably secured to one another. For purposes of this disclosure, the term "releasably" or "removably" with respect to an attachment or coupling of two structures means that the two structures may be repeatedly connected and disconnected to and from one another without material damage to either of the two structures or their functioning. For example, in one implementation, segment 348 may comprise a threaded shaft 351 (shown in broken lines) projecting from either side which are threadably received within corresponding threaded bore 353 (shown in broken lines) in segments 347 and 349. As a result, segment 347 and/or 349 may be separated from segment 348 and replaced with a different segment with different dimensions and/or formed from different materials. In yet another implementation, segments 347, 348 and 349 releasably snap to one another, allowing separation for being interchanged with different segments. As a result, the configuration and weight distribution of weight 344 may be customized. In another implementation, segment 348 can be comprised of one or more elastomeric materials to provide dampening between segments 347 and 349. Although weight 344 is illustrated as comprising three distinct segments, in other implementations, weight 344 may comprise a pair of different segments or more than three different segments. In yet other implementations, the different segments of weight 344 may be integral with one another (such as being cast as a one piece member), providing a single integral unitary body or one piece unit.

Each of the example weights 44, 144, 244 and 344 are retained within their respective tubes against relative rotational movement and axial movement with respect to the respective tube. In one implementation, as shown by FIG. 19, weight 44, 144, 244 and 344 is press fit within tube 70, wherein the weight 44, 144, 244 is frictionally retained against both rotation and axial movement with respect to tube 70.

Figure 23:
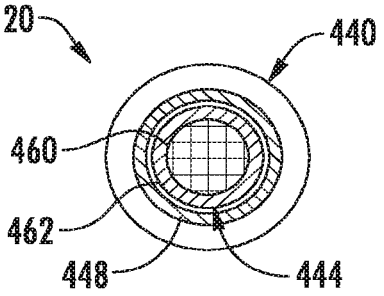
FIG. 23 is a sectional view of a portion of another example bat.

In other implementations, the weight, such as weights 44, 144, 244 and 344, may be retained against both axial movement and rotational movement by coatings deposited upon one or both of the inner surface the tube and the outer surface of the weight. FIG. 23 is a cross-sectional view of an example tube 440 containing another example weight 444. Tube 440 comprises an outer circumferential layer 446 and an inner layer 448. Outer circumferential layer 446 provides structural strength for tube 440. Inner layer 448 comprises a film, coating, laminate or other structure on the inner surface of layer 446. In one implementation, inner layer 448 comprises a material possessing a high coefficient of friction with respect to the material of the outer surface of weight 444 to resist sliding or movement of weight 444 within tube 440 once weight 444 is positioned within tube 440. In yet another implementation, inner layer 448 may comprise a material having a low coefficient of friction with respect to the material of the outer surface of weight 444 to facilitate sliding positioning of weight 444 into tube 440.

Figure 24:
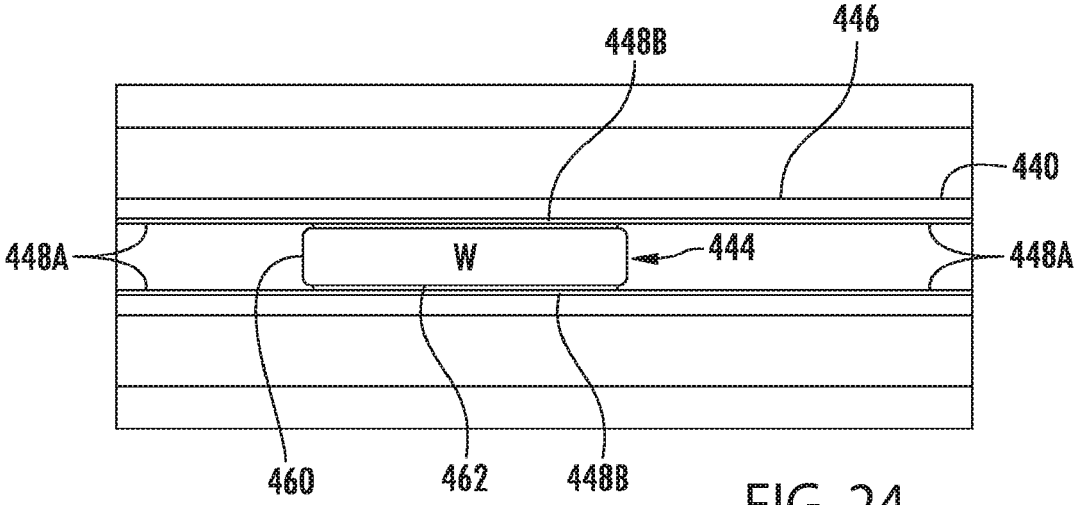
FIG. 24 is a fragmentary sectional view of the portion of the bat of FIG. 23.

As shown by FIG. 24, in some implementations, different axial regions of tube 440 may have different inner coatings or different inner layers 448A, 448B, facilitating sliding movement of weight 444 within tube 440 until weight 444 has reached a desired location within tube 440. For example, in regions within tube 440 where weight 444 is not to be located may be coated with a layer or coating 448A of a low friction material, such as polytetrafluoroethylene to facilitate sliding movement of weight 444. In locations where the weight is desired to be located, the inner surface of tube 440 may have a rougher surface texture or may be provided with a coating or layer 448B of a high friction material, such as a rubber-like material, or may be provided with a thicker coating so as to have a reduced diameter, wherein weight 444 may slide to the desired location and then be retained at the desired location by the high friction or thicker coating of tube 440.

In the example illustrated, weight 444 is multi-layered, having an inner layer or core 460 and an outer layer 462. In such an implementation, core 460 is formed from material providing the weight characteristics of weight 444. Outer layer 462 comprises a different material, such as a coating, film or laminate about core 460. In one implementation, layer 462 comprises a low friction material, such as polytetrafluoroethylene, to facilitate sliding of weight 444 within tube 440. In yet another implementation, layer 462 comprise a high friction material, such as a rubber-like material, wherein weight 444 may be pushed into tube 440 and wherein tube 444 will be retained at a desired location within tube 440 once positioned at the desired location. In yet other implementations, weight 444 may comprise a single homogenous mass of material.

Figure 25:
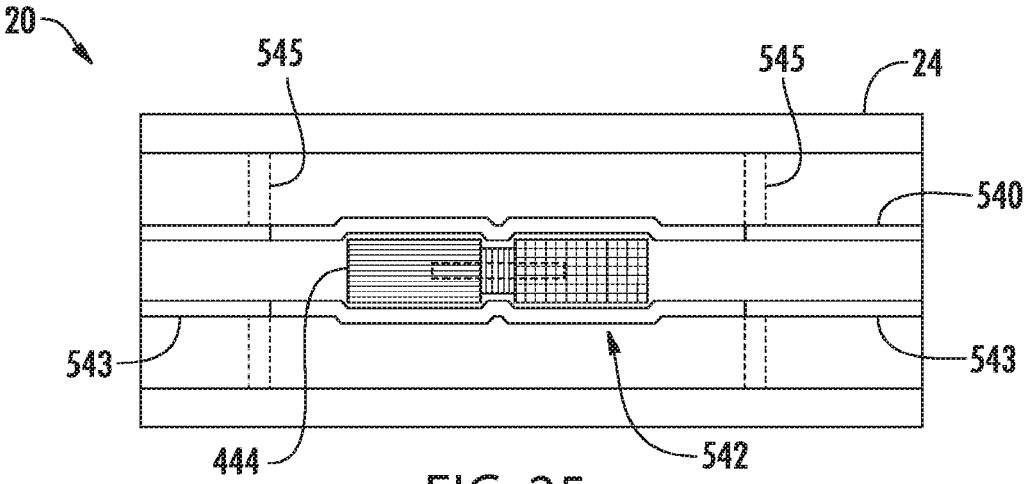
FIG. 25 is a fragmentary sectional view of a portion of another example bat.

In yet other implementations, the weight, such as weights 44, 144, 244 and 344, is retained against rotation and axial movement relative to the tube as a result of the tube resiliently deforming or flexing around or about the weight. FIG. 25 is a sectional view illustrating tube 540 containing weight 444. At least a portion of tube 540 comprises an elastomeric sleeve portion 542 which has a thickness and/or is formed from one or more materials so as to be resiliently stretchable and/or compressible. Sleeve portion 542 may be stretched or held taut between two opposite axial anchor points, such as (A) other rigid or inflexible portions 543 of tube 540 on opposite sides of sleeve portion 542 (as shown), (B) handle portion 24 and an end cap of bat 20 or (C) annular anchors 545 (shown in broken lines) extending from portions of barrel 24 on opposite axial sides of sleeve portion 542.

Sleeve portion 542 is sized less than the outer diameter or outer dimension of weight 444. During insertion of weight 444 into sleeve portion 542, sleeve portion 542 stretches and then grips the received weight 444. In the example illustrated, the inner surface of sleeve portion 542 has a shape or profile matching the outer shape or profile of the received weight, such as weight 444. In the example illustrated, the outer surface of sleeve portion 542 also has a shape or profile substantially matching the outer shape or profile of the received weight, such as weight 444. In yet other implementations, sleeve portion 542 may be resiliently compressible such that while the inner surface of sleeve portion 542 has a shape or profile substantially matching the outer shape or profile of the received weight, the outer surface of sleeve portion 542 does not substantially change in response to receipt of the weight by sleeve portion 542, wherein the change in shape of the inner surface of sleeve portion 542 is "absorbed" by the resulting compression of the material forming sleeve portion 542.

In one implementation, sleeve portion 542 is sufficiently stretchable/compressible and resiliently flexible to allow reception of weight 444 so as to deform and wrap at least partially about weight 444, while at the same time, being sufficiently inelastic so as to prevent sleeve portion 542 from radially moving into contact with barrel 26 during impact of barrel 26 with the ball during a swing. In one implementation, the entirety of tube 540 is formed from a resiliently flexible and stretchable material. In another implementation, selected portions of tube 540 are formed from a resiliently flexible and stretchable and/or compressible material.

Figure 26:
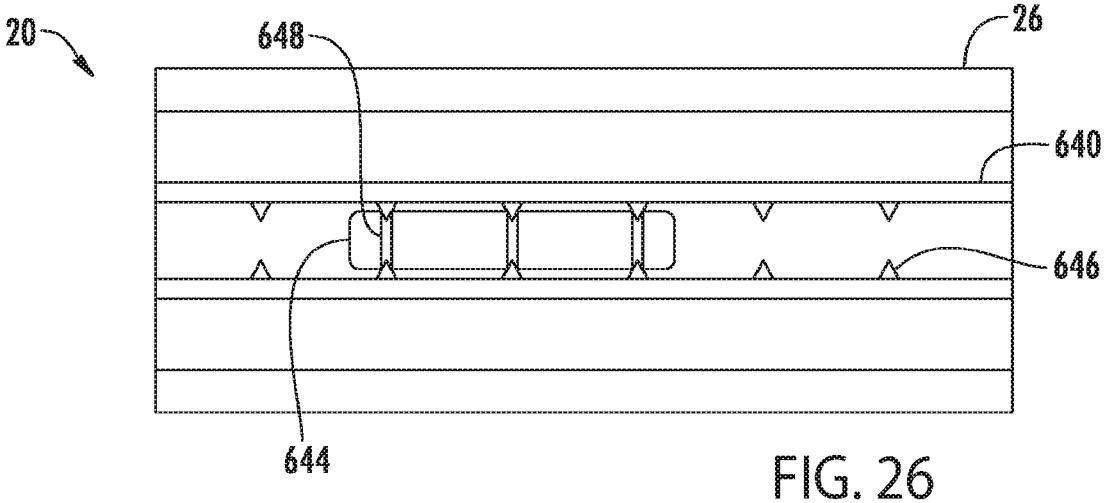
FIG. 26 is a fragmentary sectional view of a portion of another example bat.
Figure 27:
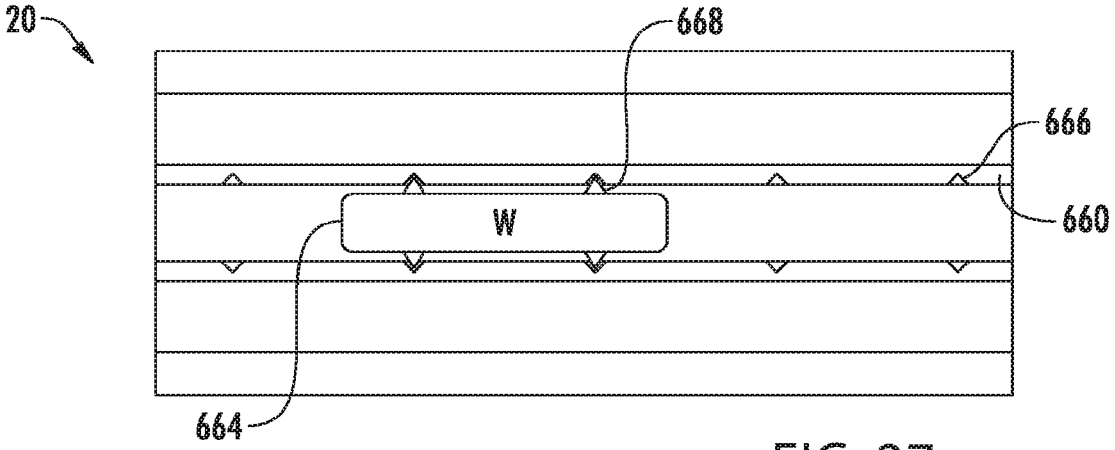
FIG. 27 is a fragmentary sectional view of a portion of another example bat.

In yet other implementations, the weight, such as weights 44, 144, 244 and 344, may be retained against both axial movement and rotational movement by a plurality of recesses, grooves or channels, and one or more generally resilient projections or tabs. The recesses, grooves or channels can be positioned on either the inner surface of the tube or on the outer surface of the received weight, and the one or more projections can be positioned on the opposite surfaces of the tube or the weight. FIG. 26 is a sectional view illustrating a portion of barrel portion 26 of bat 20 and further illustrating tube 640, and weight 644. In the example illustrated, tube 640 comprises a plurality of spaced inwardly projecting projections 646. Projection 646 are resiliently flexible stretchable to a sufficient degree so as to sufficiently bend to allow weight 644 to pass across such projections when being forced along tube 640. In the example illustrated, projections 646 comprise a plurality of circumferentially spaced teeth about the inner surface of tube 640. In other implementations, projections 646 may each comprise an annular rib having a pointed, flat around the tip and continuously extending about the inner surface of tube 640. In the example illustrated, tube 640 comprises a number of projection 646 spaced along tube 640 by distance greater than a length of weight 644, facilitating the positioning of weight 644 at any one of a plurality of multiple different positions axially along tube 640. In yet other implementations, tube 640 may comprise a single projection 646 or a single set of projection 646 that prescribe the location for weight 644.

Weight 644 is similar to weight 44 described above except that weight 644 comprises at least one detent, provided by an annular groove 648 that is sized to receive a projection or group of projections 646. In the example illustrated, weight 644 comprises a plurality of such grooves 648, wherein the grooves 648 are axially spaced with a center-to-center pitch that matches the center-to-center pitch of projections 646 along tube 640. In yet other implementations, such as in implementations where projection 646 comprise a plurality of circumferentially spaced projections, in lieu of comprising a detent in the form of an annular groove 648, weight 644 may comprise a plurality of circumferentially spaced detents, the detents having a circumferential spacing matching the circumferential spacing of the circumferentially spaced projections.

In use, weight 644 is pushed through tube 640 until positioned at a desired axial location along tube 640. As weight 644 is being pushed, projections 646 resiliently flex and bend. At each available position, where projections 646 are in alignment with grooves 648, grooves 648 receive such projection 646 to audibly indicate or to indicate through tactile reception, such reception at the available weight securement location. The user may choose the particular weight securement location or continue to push (or pull) weight 644 along tube 640 to another available weight securement location.

FIG. 22 illustrates another example implementation of bat 20 which is similar to that 20 described above with respect to FIGS. 17 and 19 except that bat 20 shown in FIG. 9 comprises tube 660 and weight 664 extending from the endcap. Tube 660 comprises a plurality of axially spaced detents 666 along the inner surface of tube 660. In the example illustrated, detents 666 comprise a plurality of circumferentially spaced indentations about the inner surface of tube 660. In other implementations, detents 666 may each comprise an annular groove continuously extending about the inner surface of tube 660. In the example illustrated, tube 660 comprises a number of detents 666 spaced along tube 660 by distance greater than a length of weight 664, facilitating the positioning of weight 664 at any one of a plurality of multiple different positions axially along tube 660. In yet other implementations, tube 660 may comprise a single detent 666 or a single set of detents 666 that prescribe the location for weight 664.

Weight 664 is similar weight 44 described above except that weight 664 comprises at least one projection 668 sized to project into a selected one of detents 666 of tube 660. In the example illustrated, weight 664 comprises a plurality of such projection 668, wherein the projections 668 are axially spaced with a center-to-center pitch that matches the center-to-center pitch of detents 666 along tube 660. In yet other implementations, such as in implementations where detents 666 comprise a plurality of circumferentially spaced detents, in lieu of projection 668 each comprising an annular rib 668, weight 664 may comprise a plurality of circumferentially spaced projections 668, the projection 668 having a circumferential spacing matching the circumferential spacing of the circumferentially spaced detents 666.

In use, weight 664 is pushed through tube 660 until positioned at a desired axial location along tube 660. As weight 664 is being pushed, projection 668 resiliently flex and bend. At each available position, where projections 668 are in alignment with detents 666, detents 666 receive such projection 668 audibly indicate, or through tactile reception, such reception at the available weight securement location. The user may choose the particular weight securement location or continue to push (or pull) weight 664 along tube 660 to another available weight securement location.

In each of the implementations described above with respect to FIGS. 8 and 9, the projections 646 and 668 have corresponding grooves or detents 648, 666. In other implementations, such grooves or detents may be omitted, wherein the resiliently flexible projections 646, 668 frictionally grip and engage the opposing surface. For example, projection 646 may grip and engage the outer surface of weight 644. The projections 668 may grip and engage the inner surface of tube 660. In yet other implementations, the inner surface of tube 740 and the outer surface of weight 744 can form a set of helical threads for enabling the weight 744 to be rotated as a whole into the desired position along the tube.

Figure 28:
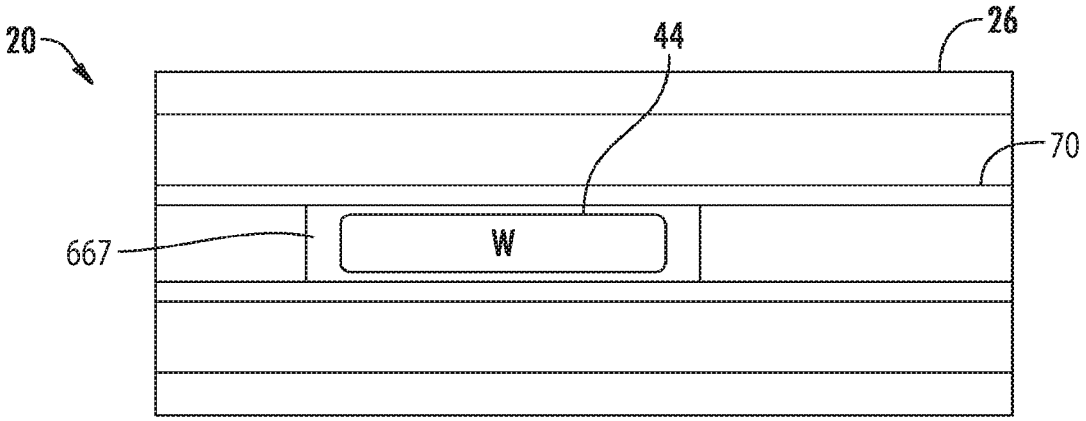
FIG. 28 is a fragmentary sectional view of a portion of another example bat.

In yet other implementations, the weight, such as weight 44, 144, 244 and 344 is axially retained in place within tube 70 by a mass of material at least partially encapsulating weight 44 and bonding to the inner surface of tube 70. FIG. 28 is a sectional view of a portion of barrel portion 26 illustrating tube 70, weight 44 and retainer 676. Tube 70 and weight 44 are described above. Retainer 676 comprises a mass of, adhesive extending between weight 44 and tube 70 so as to retain weight 44 against movement relative to tube 70 within barrel portion 26. In one implementation, retainer 676 comprises a mass of material that encapsulates weight 44. In one implementation, retainer 676 comprises a mass of material which is deposited about weight 44 within tube 70 while in a liquid or viscous state, wherein the material flows about weight 44. In one implementation, retainer 676 comprises a mass of material that is deposited into tube 70 on both sides of weight 44 while in a liquid state, encapsulating opposite end portions of weight 44. In one of the limitation on the mass media does not flow past or across weight 44 between weight 44 and tube 70. In yet another implementation, the mass material flows between weight 44 and tube 70 so as to reach both sides of weight 44. Thereafter, the mass of liquid or flowable material is solidified through evaporation or curing, bonding with the inner surface of tube 70 to retain weight 44 in place. In another implementation, retainer 676 may comprise a pair of preformed plugs secured in place on opposite sides of weight 44 within tube 70.

Figure 29:
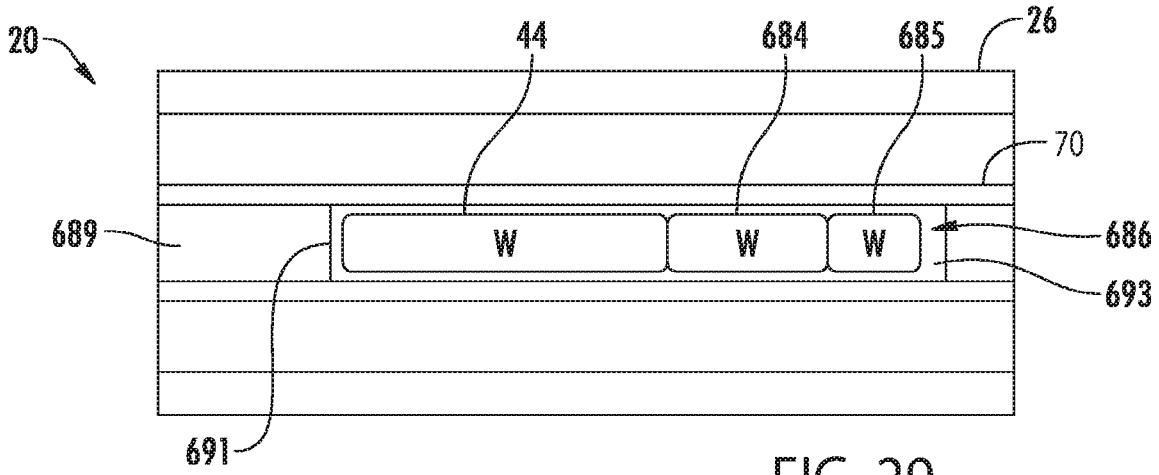
FIG. 29 is a fragmentary sectional view of a portion of another example bat.

In some implementations, the retainer similar to retainer 676 may be used to encapsulate and retain a plurality of weights within tube 70. FIG. 29 is a sectional view of a portion of barrel portion 26 of bat 20 comprising weights 44, 684 and 685 secured by retainer 686. Weight 44 is described above.

Weights 684 and 685 are similar to weight 44 except that weights 684 and 685 can have different dimensions are different weight characteristics as compared to weight 44. In the example illustrated, weight 44, weight 684 and weight 685 are arranged in a stack with their axial ends in contact with one another. In other implementations, other weights may be stacked to provide the bat 20 with other weight distribution characteristics. For example, in other implementations, tube 70 may alternatively contain two individual weights or more than three individual weights.

Retainer 686 comprises a mass of liquid or flowable material which retains weights 44, 684, 685 in place within tube 70 relative to tube 70 and relative to barrel portion 26. In one implementation, a first mass of material 689 is deposited within tube 70 while in a solid state. In another implementation, material 689 is deposited within tube 70 while in a liquid state, wherein the liquid is subsequently solidified. Material 689 has a surface 691 which serves as a stop for locating the stack of weights. Thereafter, weights are individually positioned within tube 70 and stacked upon or against stop surface 691. Once a desired selection and number of weights have been inserted into tube 70 against stop surface 691, a second mass of material 693 is deposited on top of the stack of weights. In one implementation, the second mass material 693 comprises a solid material or a plug. In another implementation, the second mass of material 693 is deposited in tube 70 while in a liquid or flowable state, wherein the mass material subsequently solidified. Materials 689 and 693 form retainer 686 which secures the stack of weights in place within tube 70 and relative to barrel portion 26. In some implementations, weights 44, 684 and 685 are secured in place within tube 70 prior to insertion of tube 70 into barrel portion 26. In another implementation, the material 693 that encapsulates weights 44, 684 and 685 may be omitted where a plug is alternatively positioned within tube 70 adjacent to weight 685 on an opposite side of weight 685 as weight 684.

Figure 30:
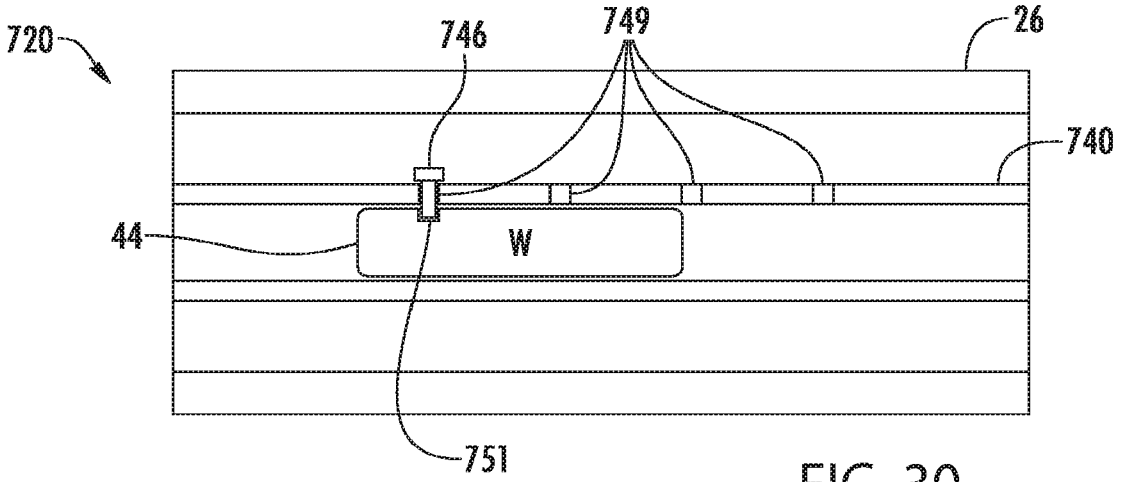
FIG. 30 is a fragmentary sectional view of a portion of another example bat.

FIG. 30 is a sectional view of a portion of barrel portion 26 of bat 720. Bat 720 is similar bat 20 except the bat 720 comprises tube 740 and retainer 746. Those remaining components of bat 720 which correspond to components of bat 20 are numbered similarly in FIG. 26 or as shown in FIGS. 1, 11, 13 and 16.

Tube 740 is similar to tube 70 except that tube 740 additionally comprises a plurality or series of openings 749 extending through and spaced along tube 740 within barrel portion 26. In one implementation, openings 749 are uniformly spaced along tube 740. In another implementation, openings 749 are non-uniformly spaced along tube 740, wherein those regions of tube 740 in which finer adjustments with regard to the positioning of weight 44 may be desirable are provided with a greater density of openings 749 (a smaller pitch between opening 749) as compared to those openings 749 in other regions of tube 740. Openings 749 cooperate with retainer 746 to secure weight 44 at a selected one of the plurality of different available positions along tube 740. In one implementation, openings 749 are internally threaded. In one implementation, retainer 746 can include two or more retainers.

Retainer 746 comprises a locator, such as a pin, which extends through a selected one of openings 749 into engagement with weight 44 so as to retain weight 44 in a selected position along tube 740. In one implementation, retainer 746 comprises a screw that screws into weight 44, wherein prior to receiving the screw, weight 44 lacks a detent or bore. In another implementation, retainer 746 comprises a screw, pin or bolt that passed through a selected one of openings 749 into a pre-existing detent 751, such as a preformed or predefined threaded or unthreaded bore, in weight 44.

Figure 31:
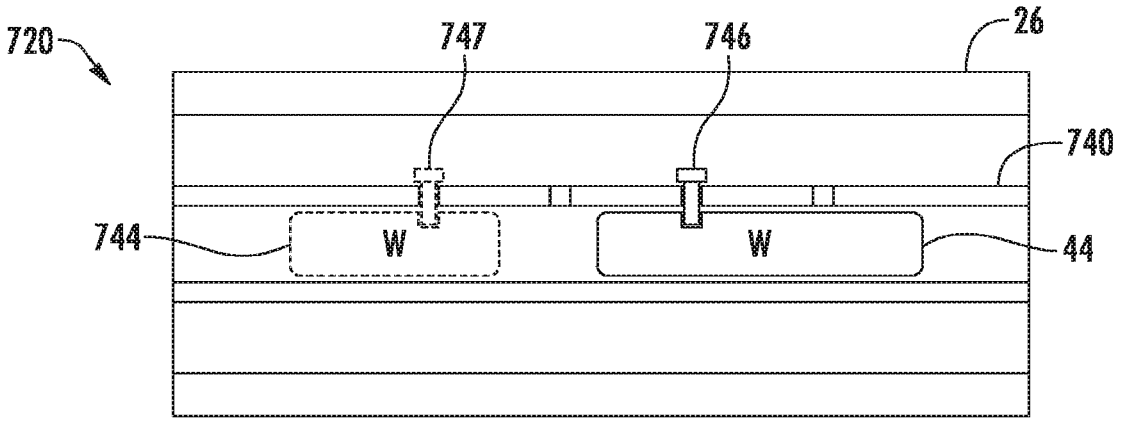
FIG. 31 is a fragmentary sectional view of the portion of the bat of FIG. 30 with an additional example weight.

FIGS. 30 and 31 illustrate use of openings 749 and retainer 746 to selectively position weight 44 at different locations within tube 740. FIG. 30 illustrates weight 44 in a first position while FIG. 31 illustrates weight 44 in a second different position. When in the first position, weight 44 is secured by the locator of retainer 746 extending through a first one of openings 749. When in the second position, weight 44 is secured by the locator of retainer 746 extending through a second one of openings 749.

FIG. 31 further illustrates the use of openings 749 to secure an additional weight 44 within tube 740. As shown in broken lines, an additional weight 744 may be located within tube 740 and may be retained in place by an additional retainer 747 in the form of a locator, similar to the locator of retainer 746. As a result, a user may add or remove weight as desired.

Figure 32:
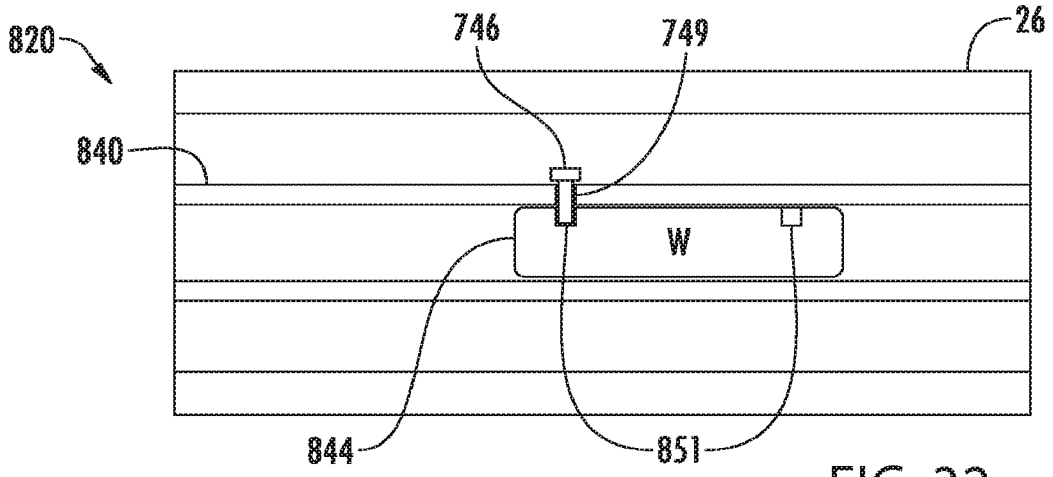
FIG. 32 is a fragmentary sectional view of a portion of another example bat with an example weight in a first position.
Figure 33:
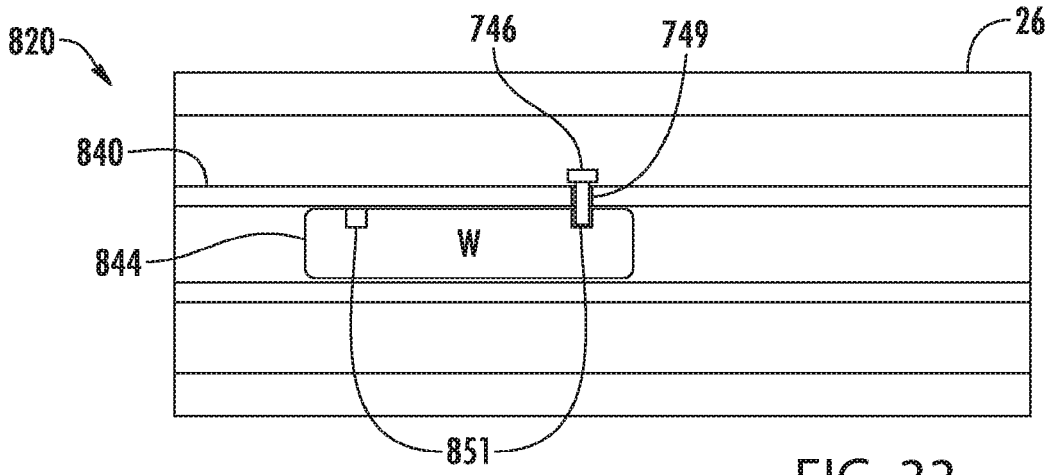
FIG. 33 is a fragmentary sectional view of the portion of the bat of FIG. 32 with the example weight in a second position.

FIGS. 32 and 33 are sectional views of a portion of barrel portion 26 of an example bat 820. Bat 820 is similar bat 20 except the bat 820 comprises tube 840, weight 844 and retainer 746. Tube 840 is similar to tube 740 except that tube 840 is illustrated as having a single opening 749. In other implementations, tube 840 may comprise additional openings 749.

Weight 844 is similar to weight 44 except that weight 844 comprises a plurality of detents 851 and axially or longitudinally spaced along weight 844. Detents 851 comprise depressions extending into weight 844 or the reception of the locator of retainer 746. As shown by FIGS. 29 and 30, detents 851 facilitate securement of weight 844 in different positions along tube 840 using a single opening 749. As a result, a user may selectively position weight 844 within tube 840 and along barrel portion 26 according to his or her preferences.

Figure 34:
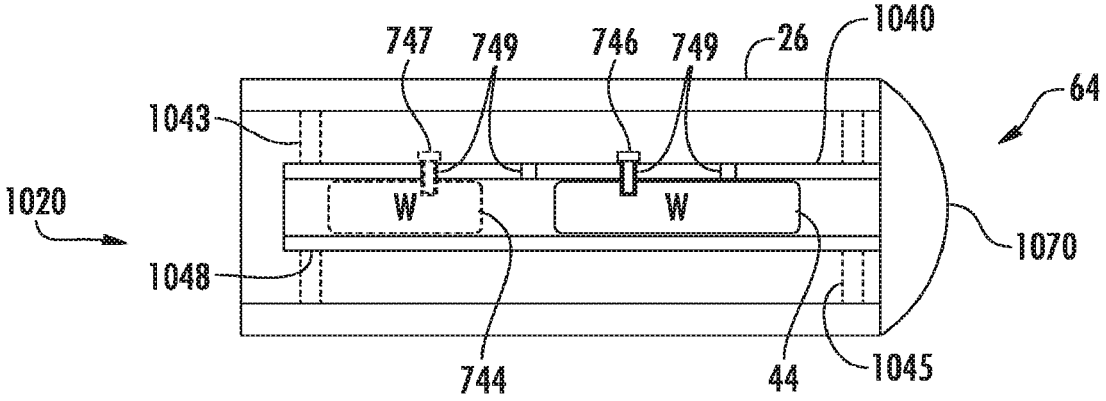
FIG. 34 is a fragmentary sectional view of a portion of another example bat.

FIG. 34 is a sectional view of a portion of an example bat 1020. Bat 1020 is similar to bat 720 described above except that bat 1020 is illustrated as comprising tube 1040 and end cap 1070. Those components of bat 1020 which correspond to components of bat 720 are numbered similarly or are shown in FIGS. 1, 11, 13 6 and 16.

Tube 1040 is similar to tube 740 described above except that tube 940 extends within barrel portion 26, terminating prior to handle portion 24. Tube 1040 is supported by end cap 1070. In particular, tube 1040 is cantilevered from end cap 1070 so as to project into barrel portion 26. In the example illustrated, tube 1040 projects at least 2 inches into barrel portion 26 towards distal end 62 and knob 22 (shown in FIG. 16) of bat 1020.

End cap 1070 comprises a structure which closes off barrel portion 26 and forms the distal end 64 of bat 1020. In the example illustrated, end cap 1070 has a curved or semi-spherical end profile or shape. In other implementations, end cap 1070 may have other outer profiles or shapes. End cap 1070 supports tube 1040. In one implementation, tube 1040 and end cap 1070 are integrally formed as a single unitary body. In yet another implementation, tube 1040 is seated within a centered bore of end cap 1070. In yet other implementations, tube 1040 may be bonded, welded, fastened or otherwise secured to end cap 1070 so as to be centered along a longitudinal centerline of bat 1020.

As indicated by broken lines in FIG. 34, in other implementations, tube 1040 may additionally or alternatively be supported by annular supports extending radially inward from barrel portion 26. In the example illustrated, bat 1020 comprises proximal annular support 1043 and distal annular support 1045. Annular supports 1043 and 1045 support opposite end portions of tube 1040. In one implementation, annular supports 1043 and 1045 comprise annular disks or rings having a central opening through which tube 1040 extends. In another implementation, annular supports 1043 and 1045 comprise a plurality of circumferential spaced spokes radially extending from tube 1040 and connected to tube 1040 and barrel portion 26. In one implementation, each of supports 1043 and 1045 may be formed of a lightweight, compressible material such as an open or closed cell polymeric foam or a lightweight elastomeric material. In one implementation, supports 1043 and 1045 have central openings 1048 sized or bound by compressible or flexible material such that tube 1040 may be slid through such openings 1048. In one implementation, supports 1043 and 1045 are integrally formed as part of a single unitary body with barrel portion 26. In another implementation, supports 1043 and 1045 are integrally formed as part of a single unitary body with tube 1040. In one implementation, supports 1043 and 1045 provide additional support for tube 1040 beyond what is provided by end cap 1070. In one implementation, support 1045 may be omitted, where one end of tube 1040 is supported by support 1043 and the other end of tube 1040 is supported by cap 1070. In another implementation, cap 1070 may be omitted or maybe distinct and independent of tube 1040 so as to not support tube 1040.

End cap 1270 is similar to end cap 1070 described above. Similar to end cap 1070, end cap 1270 supports the end of tube 1140 at distal end 64 of bat 1220. In the example illustrated, end cap 1270 comprises end portion 1272, outer ring 1274 and inner ring 1276. End portion 1272 closes off or blocks end opening of barrel portion 26. Outer ring 1274 projects from end portion 1272 and is sized so as to be press fit against the inner surface of barrel portion 26. In one implementation, adhesives, fasteners or welds may additionally be provided to further secure outer ring 1274 to barrel portion 26. Inner ring 1276 projects from end portion 1272 in words of outer ring 1274. Inner ring 1276 forms an interior cavity 1278 into which the end portion of tube 1140 is press-fit. In other implementations, tube 1140 may be further secured to inner ring 1278 by adhesives, fasteners or welds.

Figure 35:
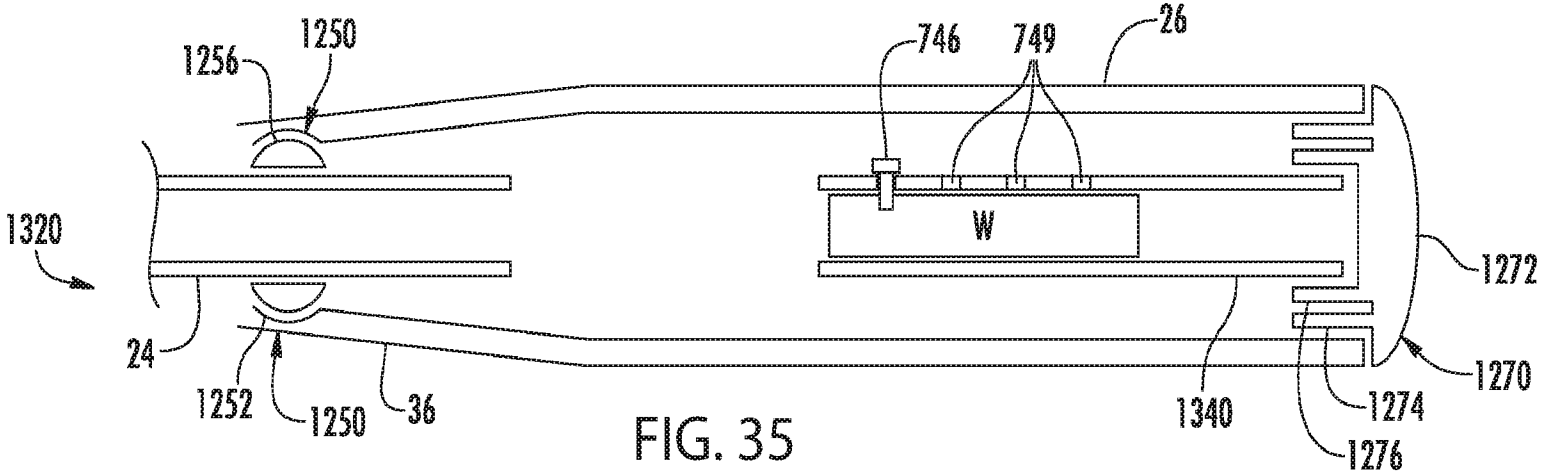
FIG. 35 is a fragmentary sectional view of a portion of another example bat.

FIG. 35 is a sectional view of a portion of an example bat 1320. Bat 1320 is similar to bat 1220 described above except that bat 1320 is illustrated as comprising tube 1340 in place of tube 1140. Those components of bat 1320 which correspond to components of bat 1220 are numbered similarly or are shown in FIG. 16.

Tube 1340 is similar to tube 1140 except that tube 1340 terminates within barrel portion 26. Similar to tube 1040 described above with respect to bat 1020 in FIG. 34, tube 1340 is supported by end cap 1270. In particular, tube 1340 is cantilevered from end cap 1270 such project into barrel portion 26. In the example illustrated, tube 1340 projects at least 2 inches into barrel portion 26 towards proximal end 62 and knob 22 (shown in FIG. 16) of bat 1320.

Figure 36:
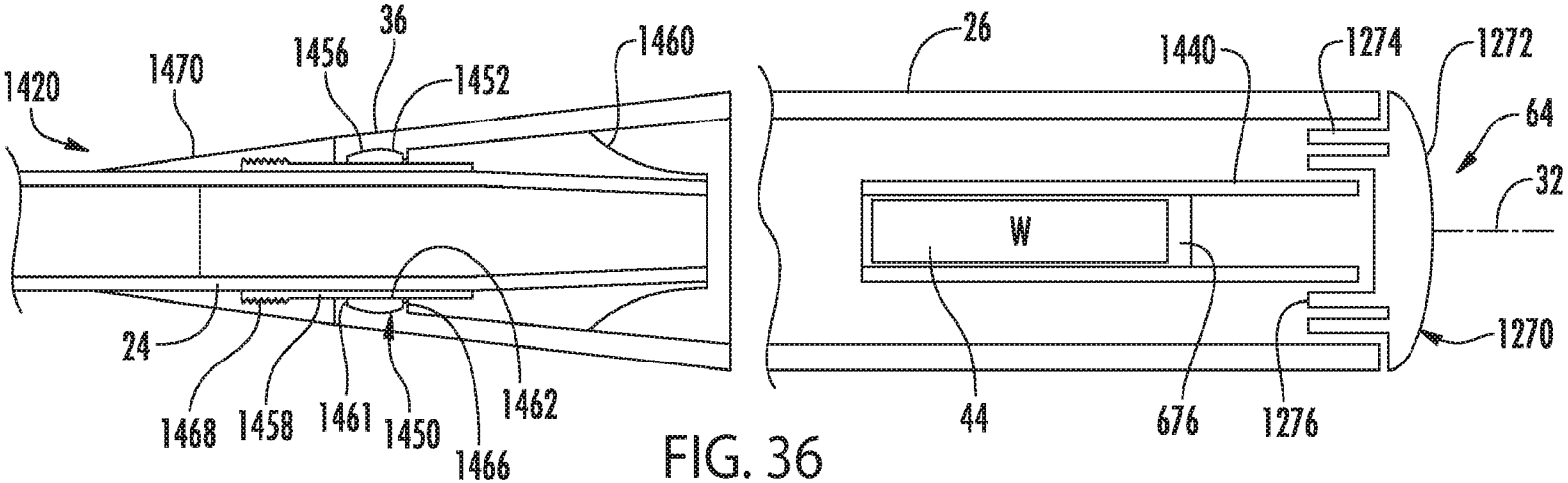
FIG. 36 is a fragmentary sectional view of a portion of another example bat.

FIG. 36 is a sectional view of a portion of an example bat 1420. Bat 1420 is similar to bat 1320 described above except that bat 1420 is illustrated as comprising tube 1440 in place of tube 1140, pivot joint 1450 in lieu of pivot joint 1250 and retainer 676 in place of retainer 746. Those components of bat 1420 which correspond to components of bat 1320 are numbered similarly or are shown in FIG. 16.

Tube 1440 is similar to tube 1140 except that tube 1440 omits openings 749. In other implementations, opening 749 may be provided in tube 1440, wherein tube 1440 is injected with retainer 676, while the material of retainer 676 is in a liquid or flowable form, through such openings 749 to secure weight 44 in place within tube 1440. Retainer 676, described above, secures weight 44 at a selected position within tube 1440 and against relative movement with respect to tube 1440. In one implementation, retainer 676 comprises a material, such as epoxy, that is injected while in a liquid or flowable state, wherein the material solidifies by evaporation or curing to secure and bond weight 44 at a selected position within and to tube 1440.

Pivot joint 1450 pivotably supports proximal region 36 of barrel portion 26 for pivotal movement about an axis perpendicular to the centerline 32 of bat 1420. Pivot joint 1450 facilitates inward deflection of barrel portion 26 when impacting a ball, enhancing or improving the performance of the barrel portion and the hitting zone of the ball bat.

As shown in FIG. 36, pivot joint 1450 comprises an annular socket 1452, annular rounded head 1456 which is movably received within socket 1452, handle interface piece 1458 and damper 1460. In the example illustrated, socket 1452 is formed along the inner surface of barrel portion 26 while rounded head 1456 is provided on the exterior of handle portion 24. In other implementations, this arrangement may be reversed.

Handle interface piece (HIP) 1458 comprise a component that is bonded to the outer diameter an outer surface of handle portion 24. HIP 1458 interconnects handle portion 24 to barrel portion 26 by supporting rounded head 1456. In the example illustrated, HIP 1458 comprises an a tube or sleeve having a pair of spaced walls 1461 that form an intermediate channel 1462 that contains a ring 1466 having an outer rounded surface forming head 1456. In other implementations, ring 1466 may be secured to HIP 1458 without being received within the intermediate channel 1462. For example, ring 1466 may be welded, bonded, mechanically snapped into or onto, or otherwise secured to HIP 1458. In some implementations, ring 1466 is omitted, wherein head 1256 is integrally formed as a single unitary body about along the exterior of HIP 1458.

In the example illustrated, the outer surface of HIP 1458 additionally includes a threaded portion 1468. Threaded portion 1468 threadably mates with corresponding threads on the interior of interface 1470. Similar to interface 960, interface 1470 provides a smooth transition between handle portion 24 and barrel portion 26. In other implementations, HIP 1458 may omit threaded portion 1468, wherein interface 1470 is secured to handle portion 24 and/or HIP 1458.

Damper 1460 comprises an elastomeric or resilient mass of material captured between handle portion 24 and the interior diameter surface of barrel portion 26 within barrel portion 26. In one implementation, damper 1460 comprises a mass of rubber or rubber-like material filling the volume between the proximal region 36 of barrel portion 26, mechanically coupled to or physically contacting the inner surface of barrel portion 26 and the outer surface of handle portion 24. In one implementation, damper 1460 is formed by filling the volume between HIP 1458 and the end of handle portion 24 with elastomeric material or rubber-like material in a liquid like state, wherein the elastomeric or rubber-like material is subsequently dried or cured to a solid-state. In yet another implementation, damper 1460 is formed by securing a tubular rubber-like sleeve about the portion of handle portion 24 that is received within barrel portion 26. Damper 1460 absorbs vibration and shock as barrel portion 26 pivots about one or both of pivot joint 1450 and pivot joint 1450.

Figure 37:
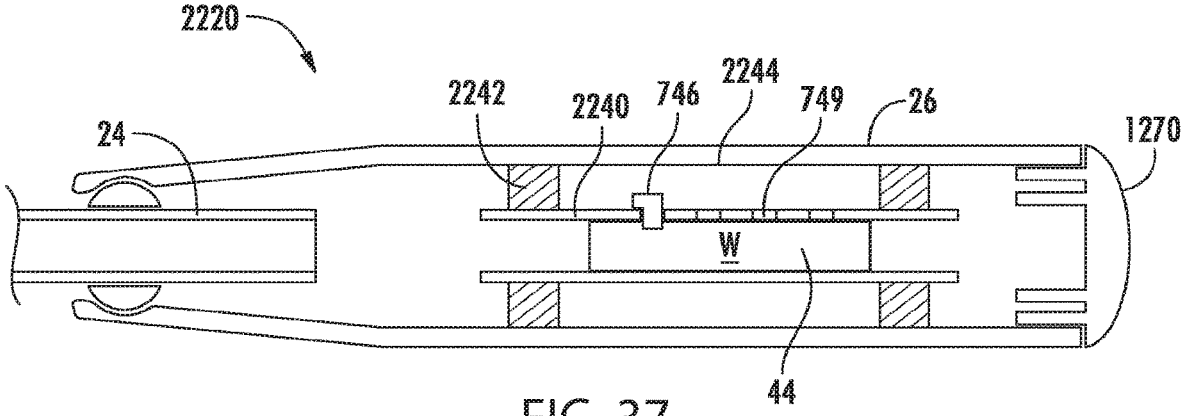
FIG. 37 is a fragmentary sectional view of a portion of another example bat.

FIG. 37 is a sectional view of a portion of an example bat 2220. Bat 2220 is similar to bat 1320 described above except tube 2240 is shown in place of tube 1340. Tube 2240 is axially spaced apart from end cap 1270, and from the handle portion 24 of bat 2220. Bat 2220 further includes at least one annular support element 2242 which couples tube 2240 to an inner surface 2244 of barrel portion 26. The annular support element 2242 can be used to securely position tube 2240 within the barrel portion 26, such as collinear with the longitudinal axis of the bat 2220. The annular support element 2242 can be a single annular element, two annular elements, or three or more annular elements. The thickness of the annular element measured with respect to the longitudinal axis of the bat 2220 can range from 0.25 in to 8 inches. In one implementation, the thickness of the annular element 2242 can be within 0.5 to 2.0 inches. In other implementations, other thicknesses can be used. The annular element 2242 is formed of one or more lightweight, tough materials, such as, for example, an open cell or closed cell foamed material, cork, plastic, a polymeric material, wood, a fiber composite material, and combinations thereof. The annular member 2242 can be formed of a highly compressible material or a stiff material such that the annular member can have a negligible effect on the stiffness (or resistance to deflection during an impact with a ball) of the bat or can significantly increase the stiffness of the bat. Accordingly, the annular member 2242 can be used to govern the performance of the bat. In one implementation, the annular member 2242 is two spaced apart annular members formed of a polyurethane foam. In other implementations, other numbers of annular members and material compositions of the annular member can be used. The annular member or members 2242 can be placed at any location along the length of tube 2240.

The tube 2240 can have a length within the range of 1.0 to 10 inches. The tube 2240 is axially spaced apart from the end cap by at least 1.0 inch, and axially spaced apart from the distal end of the handle portion 24 by at least 1.0 inch. The tube 2240 incudes at least one weight 44. The tube 2240 can also include a plurality of openings 749 and at least one retainer 746 for selectively positioning the weight 44 within the tube 2240. In another implementation, the tube 2240 can be formed without openings or a separate retainer.

Figure 38:
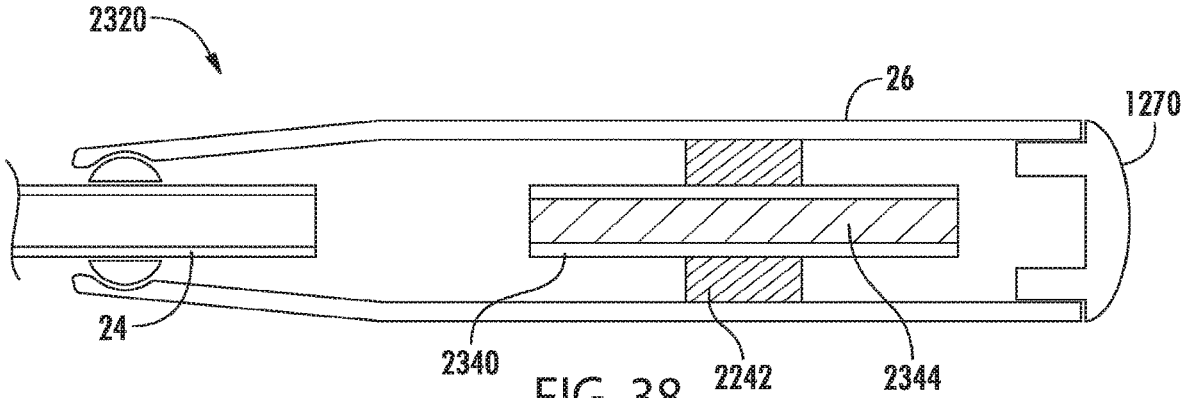
FIG. 38 is a fragmentary sectional view of a portion of another example bat.

FIG. 38 is a sectional view of a portion of an example bat 2320. Bat 2320 is similar to bat 2220 described above except tube 2340 is shown as being filled with a castable material 2344 to form a weight. Tube 2340 is axially spaced apart from end cap 1270, and from the handle portion 24 of bat 2320. Bat 2320 further includes annular support element 2342 as a single support element. The castable material 2344 can be formed of one or more materials, such as, for example, a polyurethane material, other polymeric materials, a thermoplastic material, a thermoset material, a rubber and combinations thereof. In one implementation, the castable material 2344 can substantially fill the tube 2340. In other implementations, the castable material 2344 can partially fill the tube 2340 such that it is spaced apart from one or both ends of the tube 2340. In another implementation, the tube 2340 can be a solid cylindrical body without an internal cavity or volume.

Figure 39:
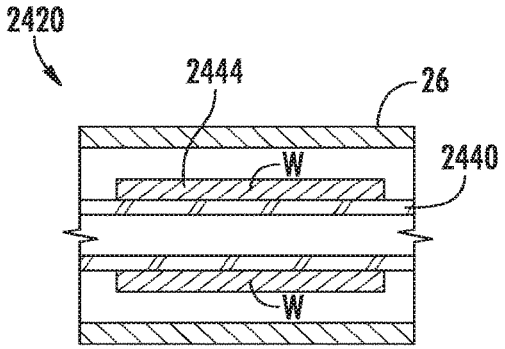
FIG. 39 is a fragmentary sectional view of a portion of another example bat.

FIG. 39 is a longitudinal, sectional view of a portion of an example bat 2420. The tube 2440 can be similar to any of the above-described tubes 70, 440, 540, 640, 740, 840, 1040, 1140, 1340, and 1440. Accordingly, tube 2420 can be coupled to the end cap 1270, the handle portion 24, both the end cap 1270 and the handle portion 24, or can be axially spaced apart from both the end cap 1270 and the handle portion 24. Weight 2444 can be positioned on the exterior of tube 2440. Weight 2444 can be molded to or attached to an outer surface of tube 2440. Weight 2444 can be formed of a castable material or a preformed solid material like weights 44, and 2344.

Figure 40:
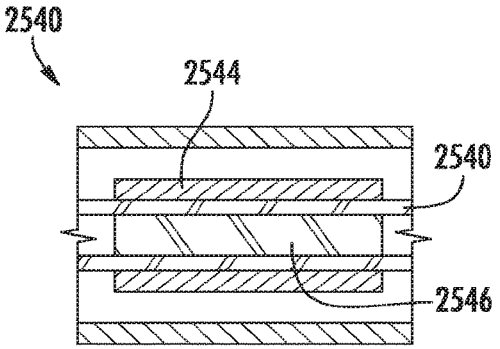
FIG. 40 is a fragmentary sectional view of a portion of another example bat.

FIG. 40 is a longitudinal, sectional view of a portion of an example bat 2520. The tube 2540 can be similar to any of the above-described tubes 70, 440, 540, 640, 740, 840, 1040, 1140, 1340, and 1440. Accordingly, tube 2520 can be coupled to the end cap 1270, the handle portion 24, both the end cap 1270 and the handle portion 24, or can be axially spaced apart from both the end cap 1270 and the handle portion 24. Weight 2544 can be positioned on the exterior of tube 2540 similar to weight 2444. Weight 2544 can be molded to or attached to an outer surface of tube 2540. The implementation of FIG. 32 further includes a second weight 2546 positioned within the tube 2520. Weight 2546 can be positioned on the interior of tube 2540 similar to weight 44, 344, 444, 644, 844, 1744 and 2344. Weight 2546 can be molded to or attached to an inner surface of tube 2540. Weights 2544 and 2546 can be formed of a castable material or a preformed solid material like weights 44, and 2344. The weight 2546 may be formed of the same material as 2544 or weight 2546 can be formed of a different material than 2544. The weight 2546 may have a longitudinal dimension or length that is the same as the length of 2544, or the lengths of weights 2544 and 2546 can vary with respect to each other.

The above disclosure describes multiple bat configurations. It should be understood that although each of the bats illustrated in FIGS. 33-40 may be utilized with any of the different weights or tubes described respect to other figures in the disclosure. For example, any of the bats disclosed in the present disclosure may utilize tube 440 or tube 540. By way of a more specific example, the bat shown in FIG. 36 may alternatively be utilized with any of weights 144, 244, 344. The bat shown in FIG. 22 may alternatively be utilized with tube 440, tube 540, tube 640 and weight 644, tube 660 and weight 664 or weight 44 with retainers 746. Although supports 1043, 1045 are illustrated with respect to the bat shown in FIG. 17, such additional supports 1043, 1045 may be provided on any of the bats described in the present disclosure.

Figure 41:
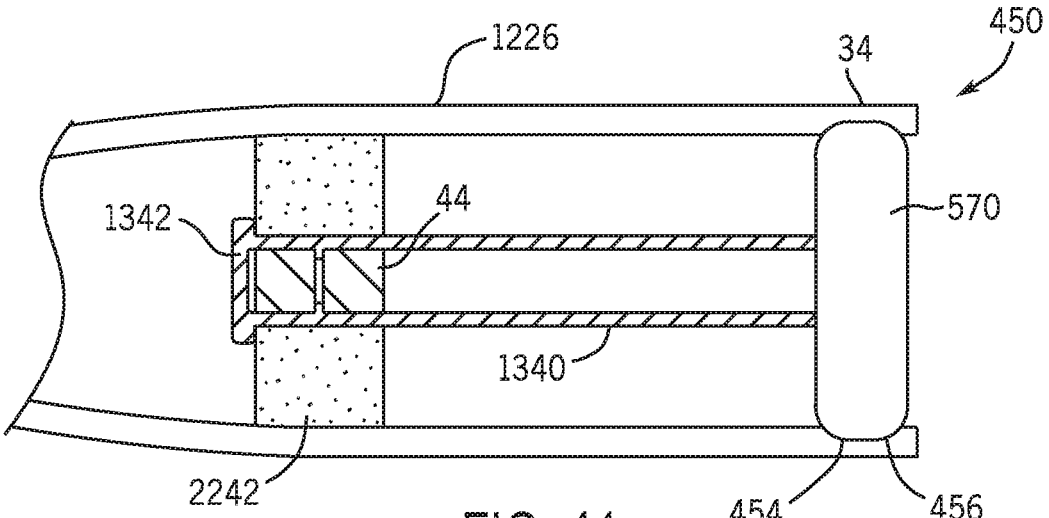
FIG. 41 is a fragmentary sectional view of a portion of another example bat.

FIG. 41 illustrates another implementation of the present invention. The example bat of FIG. 41 is similar to the example one-piece bat or bat frame of FIG. 17, except that the example bat of FIG. 41 includes a tube 1340 attached to and extending from the endcap 570. Like FIG. 17, the endcap 570 and the annular socket 454 form a pivot joint in which the annular rounded head 456 of the endcap 570 movable engages the annular socket 454 during use. The tube 1340 is similar to tube 1140 except that tube 1340 terminates within barrel portion 26. In the example illustrated, tube 1340 projects at least 4 inches into barrel portion 1226. In other examples, the tube 1340 can project into the barrel portion 1226 by other amounts, such as at least 5 inches, at least 6 inches, at least 7 inches, and other lengths. Weight 44 is secured within the tube 1340. In one implementation, the weight 44 can includes an annular recess for receiving a projection or detent inwardly projecting from the tube 1340. The size and weight of the weight 44 can be adjusted to meet the applicable needs of the bat or of a particular application. In another implementation, the tube 1340 can be formed without a weight 44. The annular rounded head 456 of the endcap 570 and the annular socket 454 form the only pivot joint within the bat 1220.

The annular support element 2242 can be used to facilitating the positioning of tube 1340 within the barrel portion 1226, such as collinear with the longitudinal axis of the bat 1220. The annular support element 2242 can be a single annular element, two annular elements, or three or more annular elements. The thickness of the annular element measured with respect to the longitudinal axis of the bat 2220 can range from 0.25 in to 8 inches. In one implementation, the thickness of the annular element 2242 can be within 0.5 to 2.0 inches. In other implementations, other thicknesses can be used. In one implementation, the annular support element is a lightweight polymeric foam that serves to dampen movement of the cantilevered end 1342 of the tube 1340 during use. In other implementations, the annular element 2242 can be formed of one or more lightweight, tough materials, such as, for example, an open cell or closed cell foamed material, cork, plastic, a polymeric material, wood, a fiber composite material, and combinations thereof. The annular member 2242 can be formed of a highly compressible material such that the annular member can have a negligible effect on the stiffness (or resistance to deflection during an impact with a ball) of the bat. In another implantation, the annular element 2242 can be formed of a stiffer material that can significantly increase the stiffness of the bat. The annular element 2242 can be secured to one or both of the inner surface of the barrel portion 1226 of the bat 1220 and the outer surface of the tube 1340 through any attachment means including, for example, adhesives, compression fits, molding and combinations thereof. In one implementation the annular element 2242 can be unsecured to one or both of the inner surface of the barrel portion 1226 of the bat and the outer surface of the tube 1340.

The tube 1340 can include a tube end 1342 that closes the proximal end of the tube 1340. In one implementation, the tube end 1342 can extend beyond the outer diameter of the tube 1340 to form a rim for facilitating the engagement of the annular element 2242 with the tube 1340.

Although the present disclosure has been described with reference to example implementations, workers skilled in the art will recognize that changes may be made in form and detail without departing from the spirit and scope of the claimed subject matter. For example, although different example implementations may have been described as including one or more features providing one or more benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements.

What is claimed is:

1. A ball bat configured for impacting a ball, the ball bat extending along a longitudinal axis, the bat comprising:

a unitary bat frame including a handle portion and a barrel portion having a distal region; and a pivot joint coupled to the distal region of the barrel portion, the pivot joint movably supporting the barrel portion relative to the longitudinal axis such that the distal region of the barrel portion may pivot towards and away from the longitudinal axis about the pivot joint.

2. The ball bat of claim 1, wherein the pivot joint includes an end cap, wherein the pivot joint comprises one of an annular socket coupled to one of the distal region of the barrel portion and the end cap, and a rounded bulbous head coupled to the other of the barrel portion and the end cap while being received within the annular socket.

3. The ball bat of claim 1, wherein the pivot joint includes an end cap, wherein the distal region of the barrel portion includes an annular groove that forms an annular socket, wherein the end cap has a rounded peripheral surface that engages the annular groove, and wherein the annular groove of the distal region of the barrel portion is configured to pivot with respect to the rounded peripheral surface upon impact with the ball.

4. The ball bat of claim 3, wherein the pivot joint is the only pivot joint incorporated within the bat.

5. The ball bat of claim 1, wherein the pivot joint further includes an end cap having a rounded peripheral surface and an annular socket member coupled to the distal region of the barrel portion, wherein the annular socket member includes an annular groove for engaging the rounded peripheral surface of the end cap.

6. The ball bat of claim 5, wherein the distal region of the barrel portion has a generally constant wall thickness.

7. The ball bat of claim 5, wherein the pivot joint is the only pivot joint within the bat.

8. The ball bat of claim 1, wherein the pivot joint further includes an end cap, and a tube attached to and extending from the end cap into the barrel portion of the bat.

9. The ball bat of claim 8, wherein the tube extends at least 4 inches into the barrel portion of the tube.

10. The ball bat of claim 8, wherein a weight is positioned within the tube.

11. The ball bat of claim 10, wherein the weight includes a recess for engaging a projection from the tube.

12. The ball bat of claim 8, wherein an annular support member is positioned within the barrel portion of the bat and is configured to engage the tube extending within the barrel portion.

13. The ball bat of claim 12, wherein the annular support member engages the tube at its projecting end and engages the inner surface of the barrel portion.

14. The ball bat of claim 12, wherein the tube includes a tube end that closes the projecting end of the tube, and wherein the tube end extends beyond the diameter of the tube to form a rim at the end of the tube for facilitating engagement with the annular support member.

15. The ball bat of claim 8, wherein the pivot joint is the only pivot joint within the bat.

* * * * *